US010974507B2

(12) United States Patent
Nakagawa et al.

(10) Patent No.: US 10,974,507 B2
(45) Date of Patent: Apr. 13, 2021

(54) LIQUID EJECTION HEAD, LIQUID EJECTION APPARATUS, AND LIQUID EJECTION MODULE

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,054

(22) Filed: Jul. 30, 2019

(65) Prior Publication Data

US 2020/0039219 A1 Feb. 6, 2020

(30) Foreign Application Priority Data

Jul. 31, 2018 (JP) ..... JP2018-143176
Apr. 18, 2019 (JP) ..... JP2019-079642

(51) Int. Cl.
*B41J 2/14* (2006.01)
*B41J 2/045* (2006.01)
*B41J 2/175* (2006.01)

(52) U.S. Cl.
CPC ..... *B41J 2/1404* (2013.01); *B41J 2/0458* (2013.01); *B41J 2/04571* (2013.01); *B41J 2/175* (2013.01); *B41J 2202/12* (2013.01)

(58) Field of Classification Search
CPC .. B41J 2/04573; B41J 2/0458; B41J 2/04571; B41J 2/175; B41J 2202/12; B41J 2/1404
See application file for complete search history.

(56) References Cited

U.S. PATENT DOCUMENTS 6,151,049 A 11/2000 Karita et al.
6,217,157 B1 4/2001 Yoshihira et al.
6,331,050 B1 * 12/2001 Nakata ..... B41J 2/14024 347/65
6,431,688 B1 8/2002 Shin et al.
(Continued)

FOREIGN PATENT DOCUMENTS

CN 1243065 A 2/2000
CN 1338379 A 3/2002
(Continued)

OTHER PUBLICATIONS

U.S. Appl. No. 16/526,024, Yoshiyuki Nakagawa, Akiko Hammura, filed Jul. 30, 2019.
(Continued)

*Primary Examiner* — Thinh H Nguyen
(74) *Attorney, Agent, or Firm* — Venable LLP

(57) ABSTRACT

A liquid ejection head includes a pressure chamber that allows a first liquid and a second liquid to flow inside, a pressure generation element that applies pressure to the first liquid and an ejection port that ejects the second liquid. The first liquid and the second liquid that flows on a side closer to the ejection port than the first liquid flow in contact with each other in the pressure chamber. The first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate of the first liquid, and $Q_2$ is a flow rate of the second liquid.

20 Claims, 14 Drawing Sheets

(56) References Cited

U.S. PATENT DOCUMENTS

| | | | |
|---|---|---|---|
| 6,474,792 | B2 | 11/2002 | Sugiyama et al. |
| 8,672,433 | B2 | 3/2014 | Kusakari |
| 8,876,247 | B2 | 11/2014 | Kobayashi |
| 9,931,845 | B2 | 4/2018 | Moriya et al. |
| 10,040,290 | B2 | 8/2018 | Okushima et al. |
| 10,300,707 | B2 | 5/2019 | Nakakubo et al. |
| 10,421,287 | B2 | 9/2019 | Yamazaki et al. |
| 2001/0015735 | A1 | 8/2001 | Matsumoto |
| 2002/0012026 | A1 | 1/2002 | Kubota et al. |
| 2005/0223847 | A1 | 10/2005 | Shiraishi et al. |
| 2010/0238232 | A1 | 9/2010 | Clarke et al. |
| 2013/0257994 | A1 | 10/2013 | Panchawagh et al. |
| 2014/0022313 | A1 | 1/2014 | Gao et al. |
| 2017/0197419 | A1 | 7/2017 | Okushima et al. |
| 2018/0370230 | A1 | 12/2018 | Nakagawa et al. |
| 2019/0001672 | A1 | 1/2019 | Hammura et al. |
| 2019/0009554 | A1 | 1/2019 | Nakagawa |
| 2019/0092011 | A1 | 3/2019 | Nakagawa et al. |

FOREIGN PATENT DOCUMENTS

| | | | |
|---|---|---|---|
| CN | 102963131 | A | 3/2013 |
| JP | 05-169663 | A | 7/1993 |
| JP | 06-305143 | A | 11/1994 |
| JP | 10-24565 | A | 1/1998 |
| JP | 2007-112099 | A | 5/2007 |
| WO | 2018/193446 | A1 | 10/2018 |

OTHER PUBLICATIONS

U.S. Appl. No. 16/526,285, Yoshiyuki Nakagawa, Akiko Hammura, filed Jul. 30, 2019.

U.S. Appl. No. 16/526,312, Yoshiyuki Nakagawa, Akiko Hammura, filed Apr. 30, 2019.

Extended European Search Report dated Nov. 28, 2019, in European Patent Application No. 19189001.1.

Office Action dated Sep. 30, 2020, in Indian Patent Application No. 201944030676.

Pffice Action dated Dec. 24, 2020, in Chinese Patent Application No. 201910694720.5.

* cited by examiner

LIQUID EJECTION HEAD, LIQUID EJECTION APPARATUS, AND LIQUID EJECTION MODULE

BACKGROUND OF THE INVENTION

Field of the Invention

This disclosure is related to a liquid ejection head, a liquid ejection module, and a liquid ejection apparatus.

Description of the Related Art

Japanese Patent Laid-Open No. H06-305143 discloses a liquid ejection unit configured to bring a liquid serving as an ejection medium and a liquid serving as a bubbling medium into contact with each other on an interface, and to eject the ejection medium with growth of a bubble generated in the bubbling medium receiving transferred thermal energy. Japanese Patent Laid-Open No. H06-305143 describes formation of flows of the ejection medium and the bubbling medium by applying a pressure to one or both of the media.

SUMMARY OF THE INVENTION

In a first aspect of this disclosure, there is provided a liquid ejection head comprising: a pressure chamber configured to allow a first liquid and a second liquid to flow inside; a pressure generation element configured to apply pressure to the first liquid; and an ejection port configured to eject the second liquid, wherein the first liquid and the second liquid that flows on a side closer to the ejection port than the first liquid flow in contact with each other in the pressure chamber, and the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate (volume flow rate [$um^3$/us]) of the first liquid, and $Q_2$ is a flow rate (volume flow rate [$um^3$/us]) of the second liquid.

In a second aspect of this disclosure, there is provided a liquid ejection apparatus which includes a liquid ejection head, the liquid ejection head comprising: a pressure chamber configured to allow a first liquid and a second liquid to flow inside; a pressure generation element configured to apply pressure to the first liquid; and an ejection port configured to eject the second liquid, wherein the first liquid and the second liquid that flows on a side closer to the ejection port than the first liquid flow in contact with each other in the pressure chamber, and the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate of the first liquid, and $Q_2$ is a flow rate of the second liquid.

In a third aspect of this disclosure, there is provided a liquid ejection module for configuring a liquid ejection head, the liquid ejection head comprising: a pressure chamber configured to allow a first liquid and a second liquid to flow inside; a pressure generation element configured to apply pressure to the first liquid; and an ejection port configured to eject the second liquid, wherein the first liquid and the second liquid that flows on a side closer to the ejection port than the first liquid flow in contact with each other in the pressure chamber, the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta^2$ is a viscosity of the second liquid, $Q_1$ is a flow rate of the first liquid, and $Q_2$ is a flow rate of the second liquid, and the liquid ejection head is formed by arraying the multiple liquid ejection modules.

Further features of the present invention will become apparent from the following description of exemplary embodiments with reference to the attached drawings.

DESCRIPTION OF THE EMBODIMENTS

Nonetheless, Japanese Patent Laid-Open No. H06-305143 does not specifically disclose correlations of physical properties of the ejection medium and the bubbling medium with flow rates for stabilizing the interface, thus failing to clarify a method of controlling flows of the ejection medium and the bubbling medium. For this reason, an interface cannot be formed well depending a combination of the ejection medium and the bubbling medium as well as other factors, thus leading to difficulties in enhancing ejection performances such as an ejection amount and an ejection velocity, and in performing a stable ejection operation.

This disclosure has been made to solve the aforementioned problem. As such, it is an object of the present invention to provide a liquid ejection head which is capable of properly controlling an interface between an ejection medium and a bubbling medium and of conducting a stable ejection operation.

(Configuration of Liquid Ejection Head)

Figure 1:
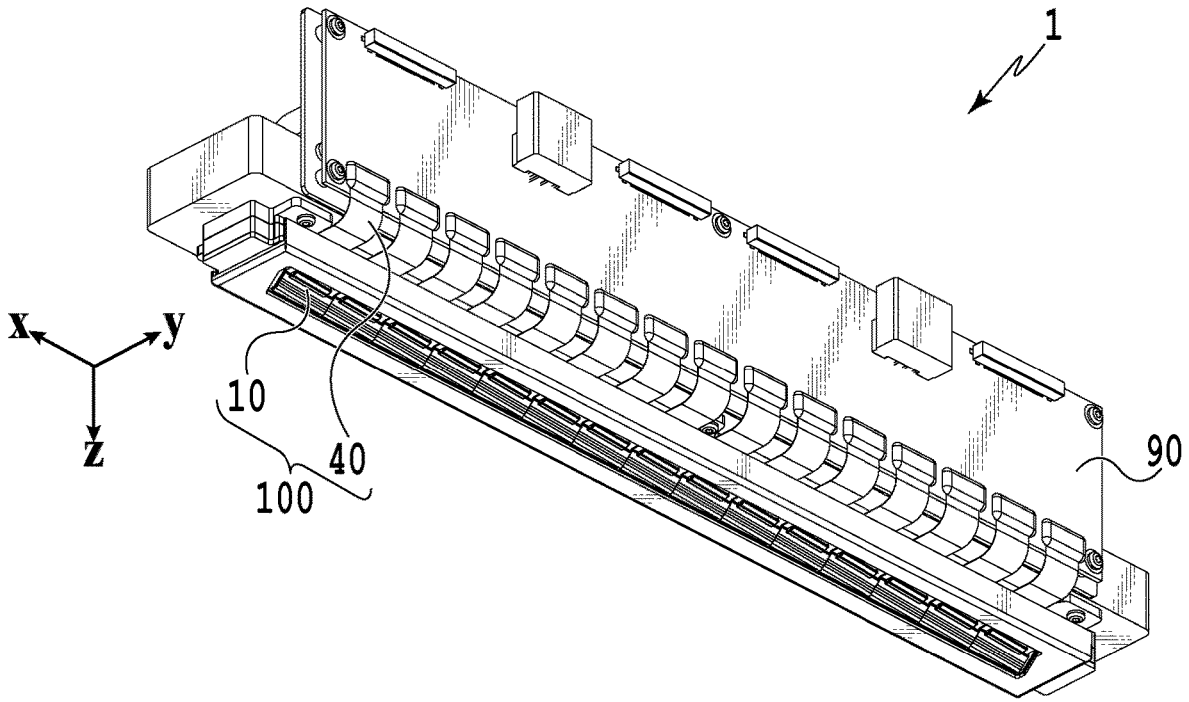
FIG. 1 is a perspective view of an ejection head.

FIG. 1 is a perspective view of a liquid ejection head 1 usable in this embodiment. The liquid ejection head 1 of this embodiment is formed by arraying multiple liquid ejection modules 100 in an x direction. Each liquid ejection module 100 includes an element board 10 on which ejection elements are arrayed, and a flexible wiring board 40 for supplying electric power and ejection signals to the respective ejection elements. The flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by the multiple arrangement of the liquid ejection modules 100 (by an array of multiple modules) in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
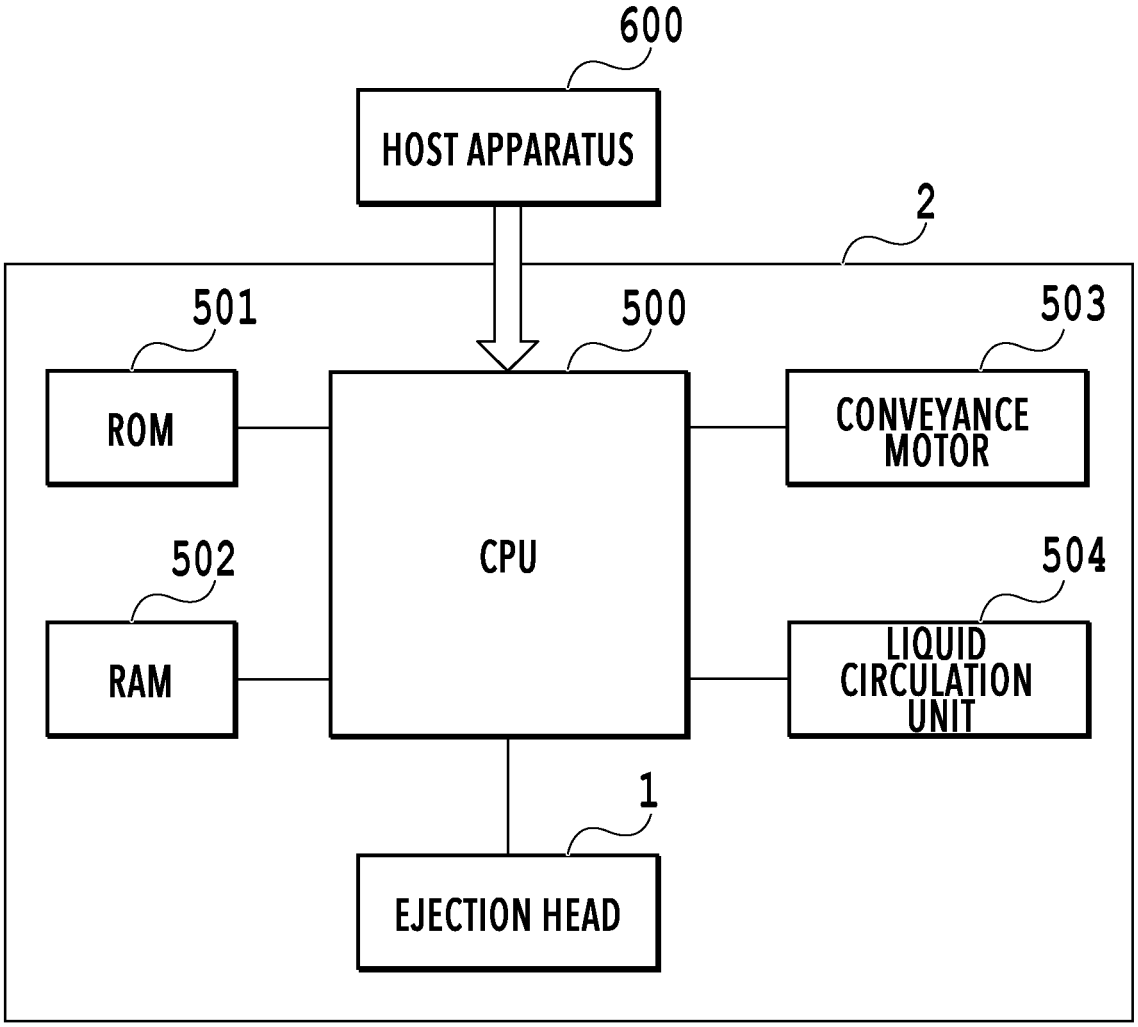
FIG. 2 is a block diagram for explaining a control configuration of a liquid ejection apparatus.

FIG. 2 is a block diagram showing a control configuration of a liquid ejection apparatus 2 applicable to this embodiment. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals to enable the liquid ejection head 1 to perform the ejection. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion.

A liquid circulation unit 504 is a unit configured to circulate and supply the liquid to the liquid ejection head 1 and to conduct flow control of the liquid in the liquid ejection head 1. The liquid circulation unit 504 includes a sub-tank to store the liquid, a flow passage for circulating the liquid between the sub-tank and the liquid ejection head 1, pumps, valve mechanisms, and so forth. Hence, under the instruction of the CPU 500, these pumps and valve mechanisms are controlled such that the liquid flows in the liquid ejection head 1 at a predetermined flow rate.

(Configuration of Element Board)

Figure 3:
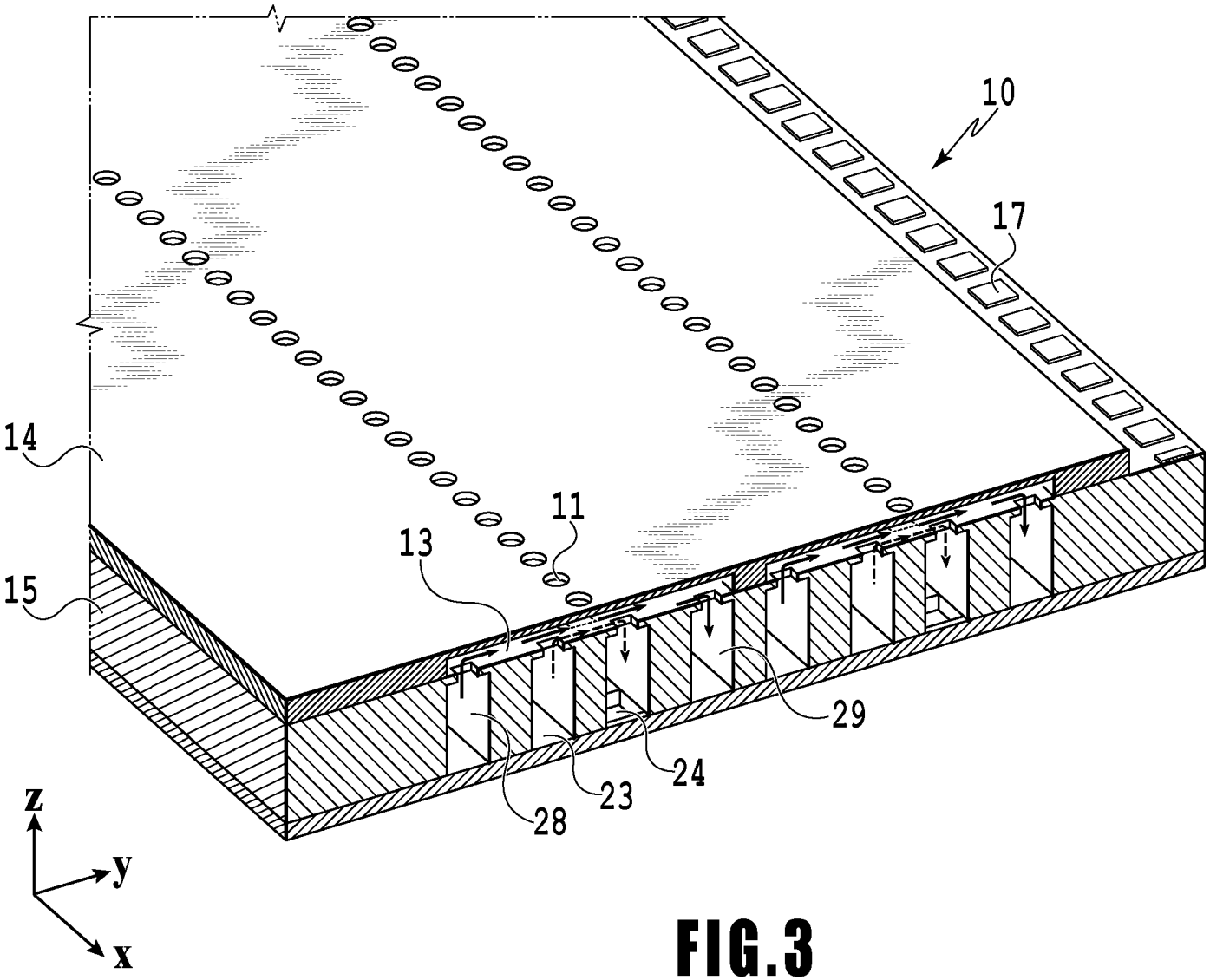
FIG. 3 is a cross-sectional perspective view of an element board in a liquid ejection module.

FIG. 3 is a cross-sectional perspective view of the element board 10 provided in each liquid ejection module 100. The element board 10 is formed by stacking an orifice plate 14 (an ejection port forming member) on a silicon (Si) substrate 15. In the orifice plate 14, ejection ports 11 to eject the liquid are arrayed in rows in the x direction. In FIG. 3, the ejection ports 11 arrayed in the x direction eject the liquid of the same type (such as a liquid supplied from a common sub-tank or a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage forming member) and the orifice plate 14 provided with the ejection ports 11 is placed thereon.

Pressure generation elements 12 (not shown in FIG. 3) are disposed, on the silicon substrate 15, at positions corresponding to the respective ejection ports 11. Each ejection port 11 and the corresponding pressure generation element 12 are located at such positions that are opposed to each other. In a case where a voltage is applied in response to an ejection signal, the pressure generation element 12 applies a pressure to at least the first liquid in a z direction orthogonal to a flow direction (a y direction) of the liquid. Accordingly, at least the second liquid is ejected in the form of a droplet from the ejection port 11 opposed to the pressure generation element 12. The flexible wiring board 40 supplies the electric power and driving signals to the pressure generation elements 12 via terminals 17 arranged on the silicon substrate 15.

The orifice plate 14 is provided with the multiple liquid flow passages 13 which extend in the y direction and are connected respectively to the ejection ports 11. Meanwhile, the liquid flow passages 13 arrayed in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 described with reference to FIG. 2. To be more precise, the liquid circulation unit 504 controls the pumps such that a first liquid flowing from the first common supply flow passage 23 into the liquid flow passages 13 is directed to the first common collection flow passage 24 while a second liquid flowing from the second common supply flow passage 28 into the liquid flow passages 13 is directed to the second common collection flow passage 29.

FIG. 3 illustrates an example in which the ejection ports 11 and the liquid flow passages 13 arrayed in the x direction, and the first and second common supply flow passages 23 and 28 as well as the first and second common collection flow passages 24 and 29 used in common for supplying and collecting inks to and from these ports and passages are defined as a set, and two sets of these constituents are arranged in the y direction.

(Configurations of Flow Passage and Pressure Chamber)

Figure 4A:
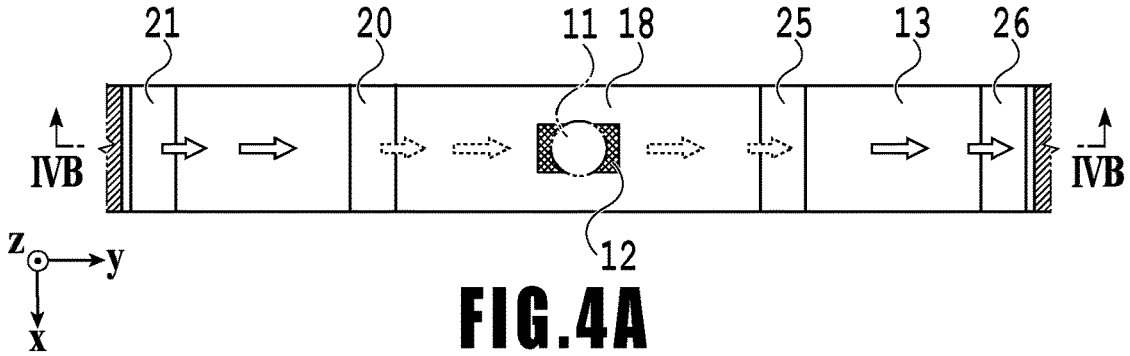
FIGS. 4A to 4D illustrate enlarged details of a liquid flow passage and a pressure chamber formed in an element board.
Figure 4B:
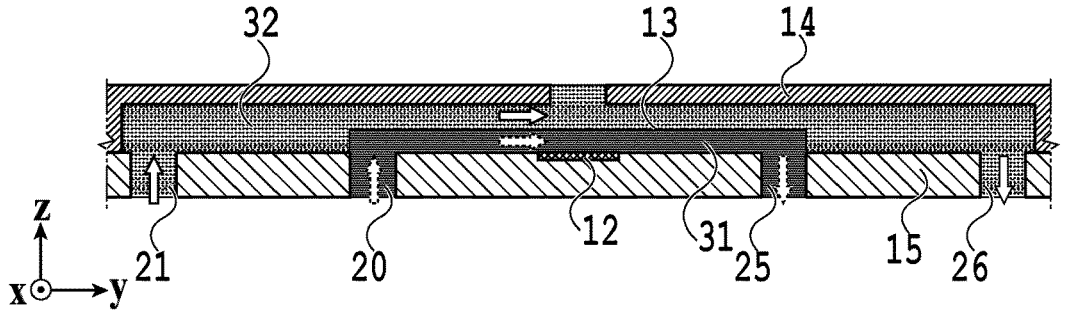
Figure 4C:
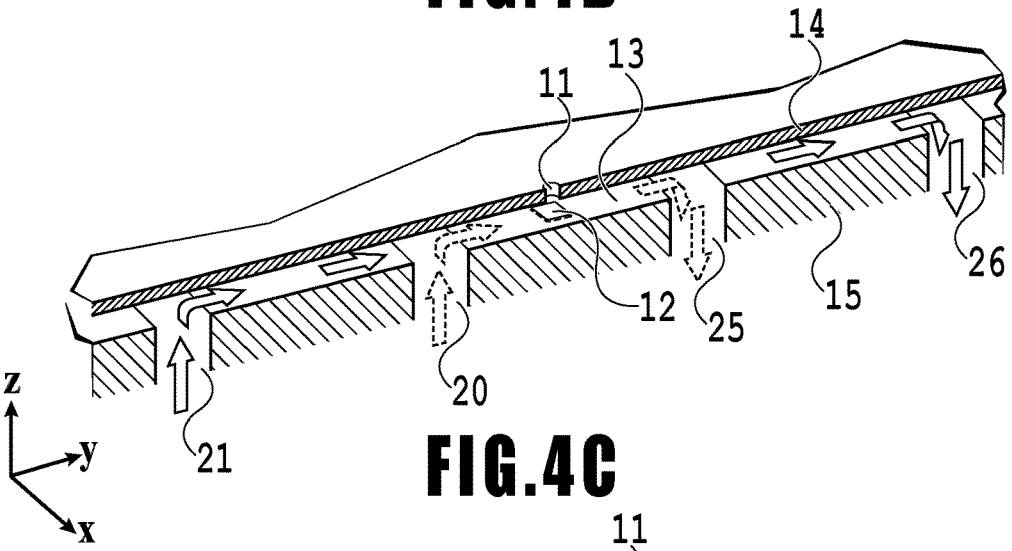
Figure 4D:
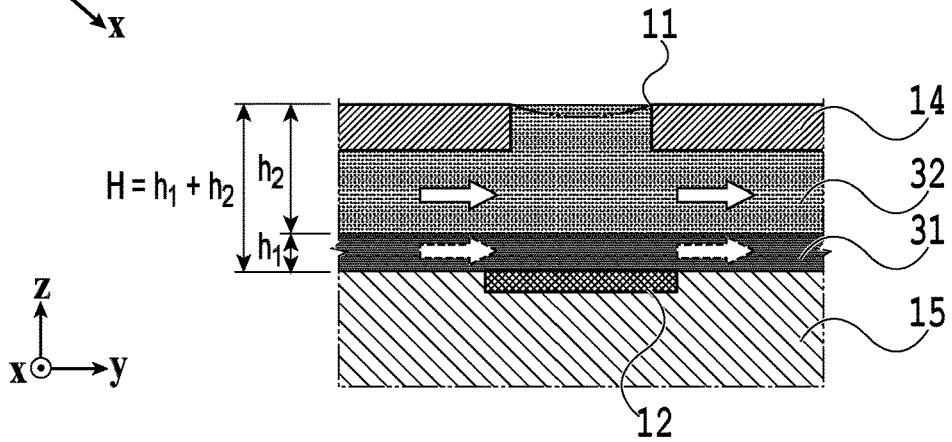

FIGS. 4A to 4D are diagrams for explaining detailed configurations of each liquid flow passage 13 and of each pressure chamber 18 formed in the element board 10. FIG. 4A is a perspective view from the ejection port 11 side (from a +z direction side) and FIG. 4B is a cross-sectional view taken along the IVB-IVB line shown in FIG. 4A. Meanwhile, FIG. 4C is an enlarged diagram of the neighborhood of each liquid flow passage 13 in the element board shown in FIG. 3. Moreover, FIG. 4D is an enlarged diagram of the neighborhood of the ejection port in FIG. 4B.

The silicon substrate 15 corresponding to a bottom portion of the liquid flow passage 13 includes a second inflow port 21, a first inflow port 20, a first outflow port 25, and a second outflow port 26, which are formed in the order of enumeration in the y direction. Moreover, the pressure chamber 18 including the ejection port 11 and the pressure generation element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29, respectively (see FIG. 3).

In the configuration described above, a first liquid 31 supplied from the first common supply flow passage 23 to the liquid flow passage 13 through the first inflow port 20 flows in the y direction (the direction indicated with arrows), then goes through the pressure chamber 18, and is collected into the first common collection flow passage 24 through the first outflow port 25. Meanwhile, a second liquid 32 supplied from the second common supply flow passage 28 to the liquid flow passage 13 through the second inflow port 21 flows in the y direction (the direction indicated with arrows), then goes through the pressure chamber 18, and is collected into the second common collection flow passage 29 through the second outflow port 26. That is to say, in the liquid flow passage 13, both of the first liquid and the second liquid flow in the y direction in a section between the first inflow port 20 and the first outflow port 25.

In the pressure chamber 18, the pressure generation element 12 comes into contact with the first liquid 31 while the second liquid 32 exposed to the atmosphere forms a meniscus in the vicinity of the ejection port 11. The first liquid 31 and the second liquid 32 flow in the pressure chamber 18 such that the pressure generation element 12, the first liquid 31, the second liquid 32, and the ejection port 11 are arranged in the order of enumeration. Specifically, assuming that the pressure generation element 12 is located on a lower side and the ejection port 11 is located on an upper side, the second liquid 32 flows above the first liquid 31. The first liquid 31 and the second liquid 32 flow in a laminar state. Moreover, the first liquid 31 is pressurized by the pressure generation element 12 located below and the second liquid 32 is ejected upward from the bottom. Note that this up-down direction corresponds to a height direction of the pressure chamber 18 and of the liquid flow passage 13.

In this embodiment, a flow rate of the first liquid 31 and a flow rate of the second liquid 32 are adjusted in accordance with physical properties of the first liquid 31 and physical properties of the second liquid 32 such that the first liquid 31 and the second liquid 32 flow in contact with each other in the pressure chamber as shown in FIG. 4D. Modes of the above-mentioned two liquids include not only parallel flows in which the two liquids flow in the same direction as shown in FIG. 4D, but also opposed flows in which the second liquid flows in an opposite direction to the flow of the first liquid, and such flows of liquids in which the flow of the first liquid crosses the flow of the second liquid. In the following, the parallel flows among these modes will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, it is preferable to drive the pressure generation element in a state where the interface is stable. Nevertheless, this embodiment is not limited only to this configuration. Even if the flow inside the pressure chamber 18 would transition to a state of turbulence whereby the interface between the two liquids would be somewhat disturbed, the pressure generation element 12 may still be driven in the case where it is possible to maintain the state where at least the first liquid flows mainly on the pressure generation element 12 side and the second liquid flows mainly on the ejection port 11 side. The following description will be mainly focused on the example where the flow inside the pressure chamber is in the state of parallel flows and in the state of laminar flows.

(Conditions to Form Parallel Flows in Concurrence with Laminar Flows)

Conditions to form laminar flows of liquids in a tube will be described to begin with. The Reynolds number to represent a ratio between viscous force and interfacial force has been generally known as a flow evaluation index.

Now, a density of a liquid is defined as ρ, a flow velocity thereof is defined as u, a representative length thereof is defined as d, a viscosity is defined as η, and a surface tension thereof is defined as γ. In this case, the Reynolds number can be expressed by the following (formula 1):

$$Re=\rho ud/\eta \quad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than some 2200 and the flows inside the circular tube become turbulent flows in the case where the Reynolds number Re is larger than some 2200.

In the case where the flows are formed into the laminar flows, flow lines become parallel to a traveling direction of the flows without crossing each other. Accordingly, in the case where the two liquids in contact constitute the laminar flows, the liquids can form the parallel flows while stably defining the interface between the two liquids.

Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density $\rho=1.0\times103$ kg/m$^3$, viscosity $\eta=1.0$ cP) is fed to the liquid flow passage of the inkjet printing head at a flow velocity of 100 mm/s, the Reynolds number Re turns out to be $Re=\rho ud/\eta\approx0.1\sim1.0<<2200$. As a consequence, the laminar flows can be deemed to be formed therein.

Here, even if the liquid flow passage 13 and the pressure chamber 18 of this embodiment have rectangular cross-sections as shown in FIGS. 4A to 4D, the heights and widths of the liquid flow passage 13 and the pressure chamber 18 in the liquid ejection head are sufficiently small. For this reason, the liquid flow passage 13 and the pressure chamber 18 can be treated like in the case of the circular tube, or more specifically, the heights of the liquid flow passage and the pressure chamber 18 can be treated as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 4D. First of all, a distance from the silicon substrate 15 to an ejection port surface of the orifice plate 14 is defined as H [μm] and a distance from the ejection port surface to a liquid-liquid interface between the first liquid 31 and the second liquid 32 (a phase thickness of the second liquid) is defined as $h_2$ [μm]. In the meantime, a distance from the liquid-liquid interface to the silicon substrate 15 (a phase thickness of the first liquid) is defined as $h_1$ [μm]. These definitions bring about $H=h_1+h_2$.

As for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the liquid-liquid interface are assumed to have continuity. Based on the assumption, if the first liquid 31 and the second liquid 32 form two-layered and parallel steady flows, then a quartic equation as defined in the following (formula 2) holds true in a section of the parallel flows:

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad \text{(formula 2).}$$

In the (formula 2), $\eta_1$ [cP] represents the viscosity of the first liquid, $\eta_2$ [cP] represents the viscosity of the second liquid, $Q_1$ [$mm^3/s$] represents the flow rate of the first liquid, and $Q_2$ [$mm^3/s$] represents the flow rate of the second liquid. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, at least the flows of the liquids in a region above the pressure generation element preferably establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flow in the pressure chamber, it is preferable that at least the first liquid flow mainly on the pressure generation element side and the second liquid flow mainly on the ejection port side.

Figure 5A:
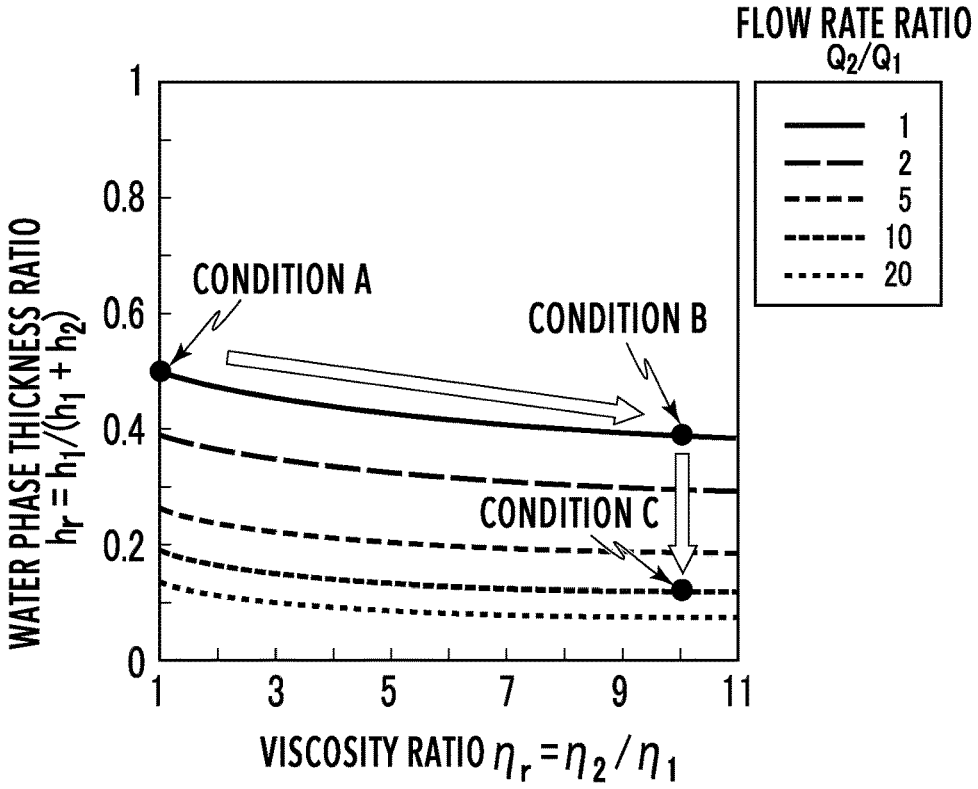
FIGS. 5A and 5B are graphs representing relations between a viscosity ratio and a water phase thickness ratio, and relations between a height of the pressure chamber and a flow velocity.

FIG. 5A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels based on the (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$. The water phase thickness ratio $h_r$ becomes lower as the flow rate ratio $Q_r$ grows higher. Meanwhile, at each level of the flow rate ratio $Q_r$, the water phase thickness ratio $\eta_r$ becomes lower as the viscosity ratio $\eta_r$ grows higher. In other words, the water phase thickness ratio $h_r$ (the position of the interface between the first liquid and the second liquid) in the liquid flow passage 13 (the pressure chamber) can be adjusted to a prescribed value by controlling the viscosity ratio $\eta_r$ and the flow rate ratio $Q_r$ between the first liquid and the second liquid. In addition, in the case where the viscosity ratio $\eta_r$ is compared with the flow rate ratio $Q_r$, FIG. 5A teaches that the flow rate ratio $Q_r$ has a larger impact on the water phase thickness ratio $h_r$ than the viscosity ratio $\eta_r$ does.

Here, regarding the water phase thickness ratio $h_r=h_1/(h_1+h_2)$, the parallel flows of the first liquid and the second liquid are formed in the liquid flow passage (the pressure chamber) in the case where $0<h_r<1$ (condition 1) is satisfied. However, as described later, this embodiment is configured to allow the first liquid to function mainly as the bubbling medium and to allow the second liquid to function mainly as the ejection medium, and to stabilize the first liquid and the second liquid contained in ejected droplets at a desired proportion. Given the circumstances, the water phase thickness ratio $h_r$ is preferably equal to or below 0.8 (condition 2) or more preferably equal to or below 0.5 (condition 3).

Note that condition A, condition B, and condition C shown in FIG. 5A represent the following conditions, respectively:

Condition A) the water phase thickness ratio $h_r=0.50$ in the case where the viscosity ratio $\eta_r=1$ and the flow rate ratio $Q_r=1$;

Condition B) the water phase thickness ratio $h_r=0.39$ in the case where the viscosity ratio $\eta_r=10$ and the flow rate ratio $Q_r=1$; and Condition C) the water phase thickness ratio $h_r=0.12$ in the case where the viscosity ratio $\eta_r=10$ and the flow rate ratio $Q_r=10$.

Figure 5B:
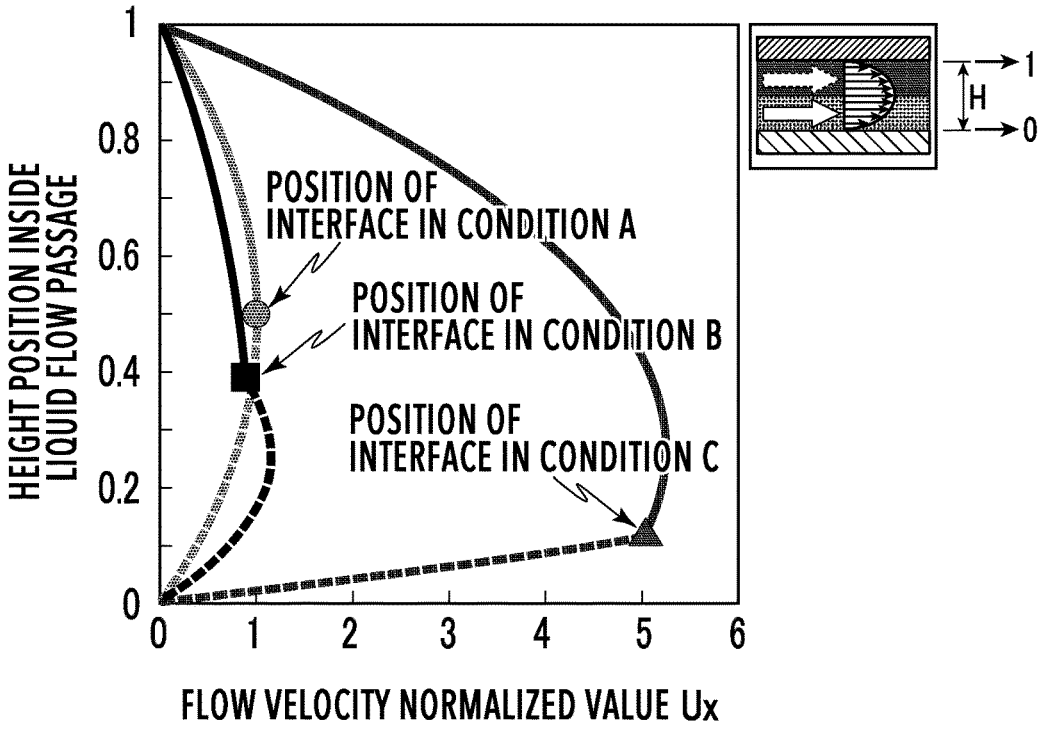

FIG. 5B is a graph showing flow velocity distribution in the height direction (the z direction) of the liquid flow passage 13 (the pressure chamber) regarding the above-mentioned conditions A, B, and C, respectively. The horizontal axis indicates a normalized value Ux which is normalized by defining the maximum flow velocity value in the condition A as 1 (a criterion). The vertical axis indicates the height from a bottom surface in the case where the height H of the liquid flow passage 13 (the pressure chamber) is defined as 1 (a criterion). On each of curves indicating the respective conditions, the position of the interface between the first liquid and the second liquid is indicated with a marker. FIG. 5B shows that the position of the interface varies depending on the conditions such as the position of the interface in the condition A being located higher than the positions of the interface in the condition B and the condition C. The variations are due to the fact that, in the case where the two types of liquids having different viscosities from each other flow in parallel in the tube while forming the laminar flows, respectively (and also forming the laminar flows as a whole), the interface between those two liquids is formed at a position where a difference in pressure attributed to the difference in viscosity between the liquid balances a Laplace pressure attributed to interfacial tension.

(Experimental Conditions to Form Parallel Flows in State of Laminar Flows)

The inventors of this disclosure have conducted actual measurements of the water phase thickness ratio $h_r$ regarding several cases while variously changing the flow rate ratio $Q_r$ ($=Q_2/Q_1$) and the viscosity ratio $\eta_r$ ($=\eta_2/\eta_1$) within practical ranges of the flow rate ratio $Q_r$ and the viscosity ratio $\eta_r$ based on the types and the flow rates of the inks usable in the inkjet printing apparatus. Then, based on these several cases, the following approximation formula (formula 3) to obtain the water phase thickness ratio $h_r$ from the flow rate ratio $Q_r$ and the viscosity ratio $\eta_r$ was acquired:

$$h_r=0.44(Q_2/Q_1)^{-0.322}(\eta_2/\eta_1)^{-0.109} \quad \text{(formula 3).}$$

Here, effectiveness of the (formula 3) was verified in ranges of $0.1\leq Q_r\leq 100$ and $1\leq\eta_r\leq 20$. As described above, since the flow rate ratio and the viscosity ratio are acquired within the practical ranges in the inkjet printing apparatus, the (formula 3) is derived on the premise that the flows of the two liquids in the pressure chamber are the parallel flows in the state of laminar flows. Nonetheless, the (formula 3) also holds true in the case where the flows in the pressure chamber are in a state of some turbulence and in the case where the two liquids flow in such a way as to cross each other.

(Correlation Between Theoretical Conditions and Experimental Conditions)

Figure 6:
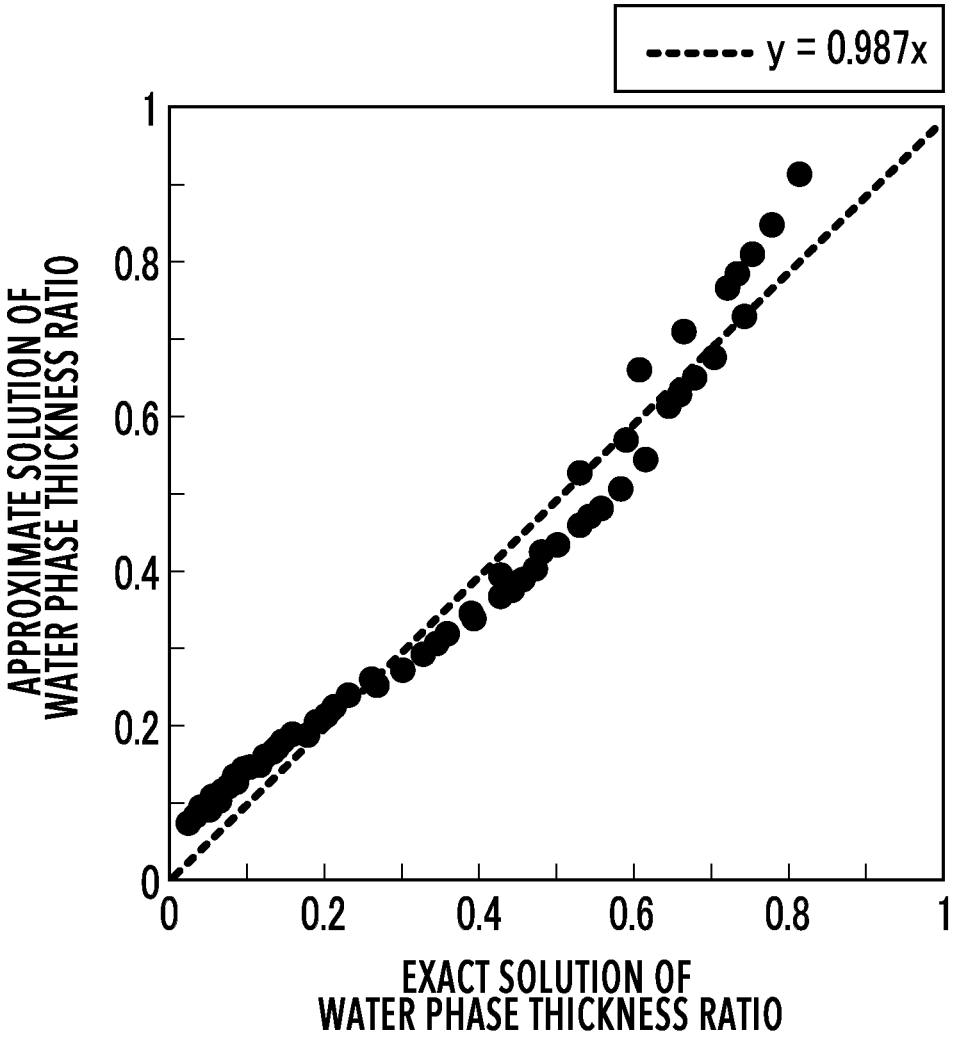
FIG. 6 is a graph showing a correlation between exact solutions and approximate solutions for forming parallel flows.

FIG. 6 is a diagram showing a correlation between exact solutions based on the (formula 2) and approximate solutions based on the (formula 3). The horizontal axis indicates the exact solution of the water phase thickness ratio $h_r$ and the vertical axis indicates the approximate solution of the water phase thickness ratio $h_r$. Here, values of the approximate solutions relative to the exact solutions are plotted regarding multiple cases in which the flow rate ratio $Q_r$ and the viscosity ratio $\eta_r$ are variously changed within the aforementioned ranges. As a consequence of seeking a correlation coefficient y based on the multiple plotted values, a correlation value y=0.987 is obtained which is very close to 1.

In other words, even if the quartic equation shown as the (formula 2) is not used, it is possible to adjust the water phase thickness ratio $h_r$ within a preferable range as long as the flow rate ratio $Q_r$ and the viscosity ratio $\eta_r$ can be controlled based on the (formula 3). Moreover, as has been described with reference to FIG. 5A, in the case where the viscosity ratio $\eta_r$ is compared with the flow rate ratio $Q_r$, it is apparent that the flow rate ratio $Q_r$ has larger impact on the water phase thickness ratio $h_r$ than the viscosity ratio $\eta_r$ does. In addition, while the viscosity ratio $\eta_r$ is fixed depending on the type of the liquid, the flow rate ratio $Q_r$ is adjustable by controlling a pump or the like for circulating the liquid. In conclusion, the inventors of this specification have reached a finding that, in order to form the stable flows of two different liquids in the liquid flow passage 13 (the pressure chamber) by using the two liquids, it is effective to adjust the water phase thickness ratio $h_r$ by controlling the flow rate ratio $Q_r$ between the two liquids based on the (formula 3).

Here, the first liquid and the second liquid may form the liquid-liquid interface at any place in the liquid flow passage and the pressure chamber as long as the above-mentioned conditions to form the parallel flows are satisfied. Specifically, as has been described above, in the case where the pressure generation element 12 is located below and the ejection port 11 is located above, the first liquid may flow on a lower (the pressure generation element) side and the second liquid may flow on an upper (the ejection port) side (see FIG. 4D). Alternatively, the first liquid and the second liquid may flow at the same height in the up-down direction and the liquid-liquid interface may be formed along the height direction. In other words, the first liquid and the second liquid may flow side by side in the x direction. In this case, the value $h_r$ in the (formula 3) represents the thickness in the x direction of the first liquid.

Now, the above-described three conditions 1 to 3 of the water phase thickness ratio $h_r$ for allowing the first liquid to function mainly as the bubbling medium and allowing the second liquid to function mainly as the ejection medium will be discussed again. In this case, in the case where the above-mentioned (formula 3) is also taken into account, (formula 4) needs to be satisfied in order to fulfill the condition 1, (formula 5) needs to be satisfied in order to fulfill the condition 2, and (formula 6) needs to be satisfied in order to fulfill the condition 3:

$$0<0.44(Q_2/Q_1)^{-0.322}(\eta_2/\eta_1)^{-0.109}<1.0 \quad \text{(formula 4);}$$

$$0<0.44(Q_2/Q_1)^{-0.322}(\eta_2/\eta_1)^{-0.109}\leq 0.8 \quad \text{(formula 5); and}$$

$$0<0.44(Q_2/Q_1)^{-0.322}(\eta_2/\eta_1)^{-0.109}\leq 0.5 \quad \text{(formula 6).}$$

(Transitional States in Ejection Operation)

Next, a description will be given of transitional states in an ejection operation in the liquid flow passage 13 and the pressure chamber 18 in which the parallel flows are formed. FIGS. 7A to 7E are diagrams schematically illustrating transitional states in an ejection operation in the liquid flow passage 13 having the height of the flow passage (the pressure chamber) H [μm]=20 μm. Meanwhile, FIGS. 8A to 8E are diagrams schematically illustrating transitional states in an ejection operation in the liquid flow passage 13 (the pressure chamber) having the height of the flow passage (the pressure chamber) H [μm]=33 μm. Moreover, FIGS. 9A to 9E are diagrams schematically illustrating transitional states in an ejection operation in the liquid flow passage 13 (the pressure chamber) having the height of the flow passage (the pressure chamber) H [μm]=10 μm. Note that each of the ejected droplets in these drawings is illustrated based on a result obtained by conducting a simulation while setting the viscosity of the first liquid to 1 cP, the viscosity of the second liquid to 8 cP, and the ejection velocity of the droplet to 11 m/s.

Figures 7A, 7B, 7C, 7D, 7E:
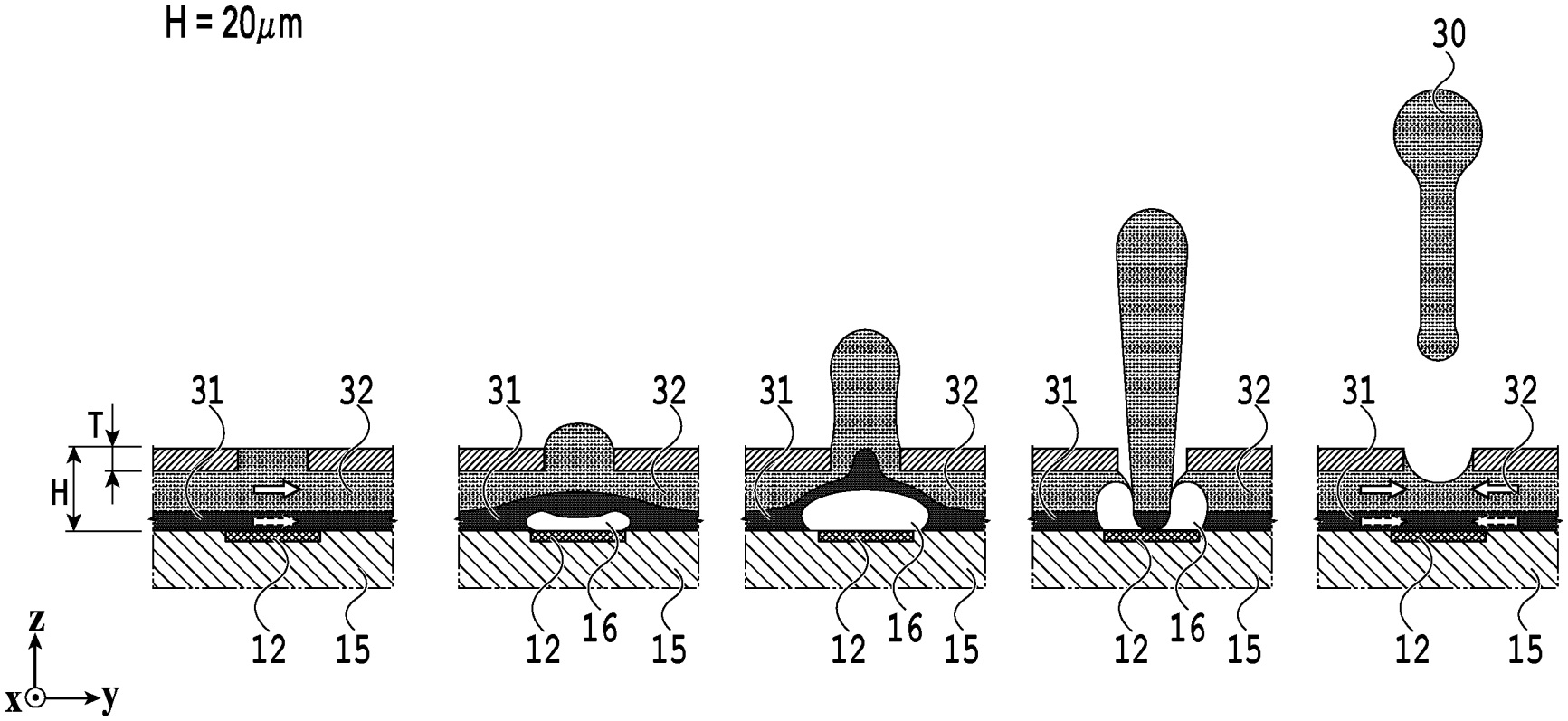
FIGS. 7A to 7E are diagrams schematically illustrating transitional states in an ejection operation.
Figures 8A, 8B, 8C, 8D, 8E:
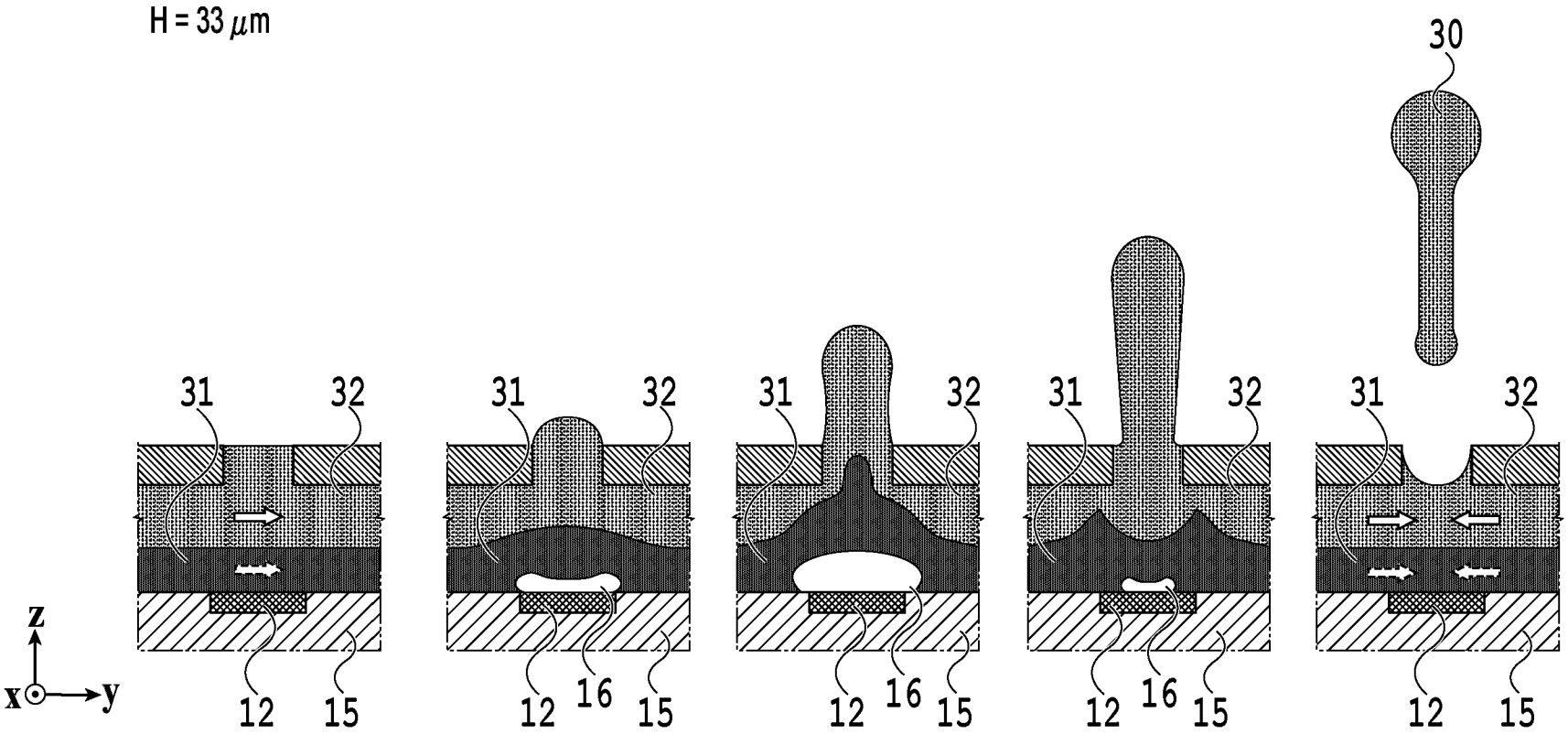
FIGS. 8A to 8E are more diagrams schematically illustrating transitional states in an ejection operation.
Figures 9A, 9B, 9C, 9D, 9E:
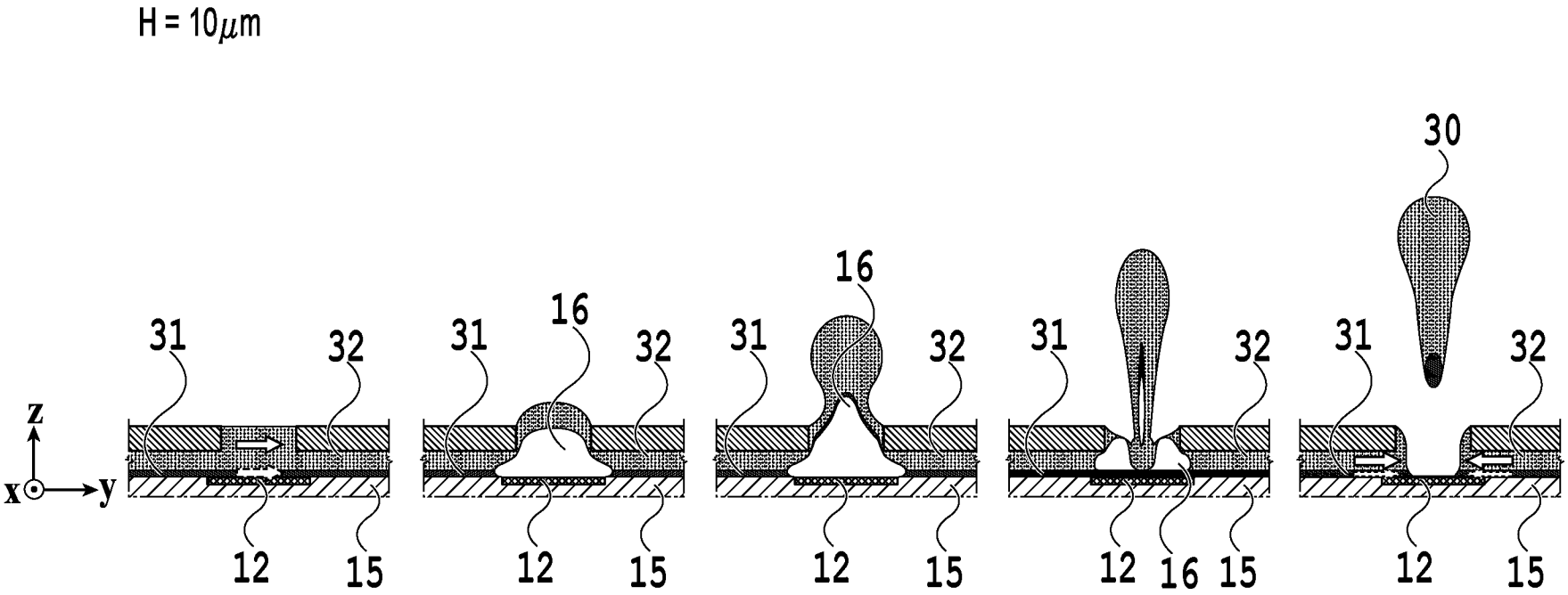
FIGS. 9A to 9E are more diagrams schematically illustrating transitional states in an ejection operation.
Figures 10A, 10B, 10C, 10D, 10E, 10F, 10G:
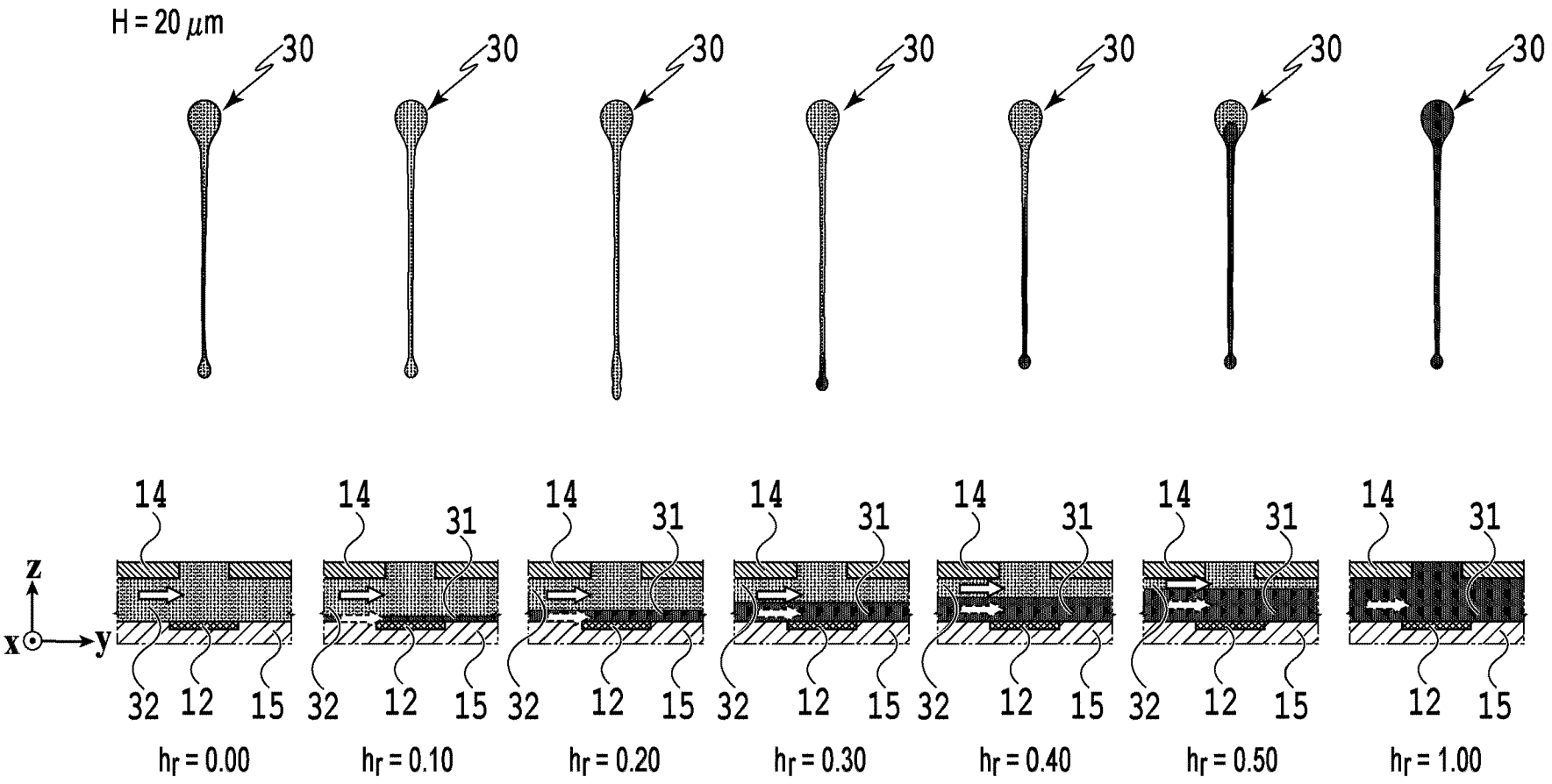
FIGS. 10A to 10G are diagrams illustrating ejected droplets at various water phase thickness ratios.
Figures 11A, 11B, 11C, 11D, 11E:
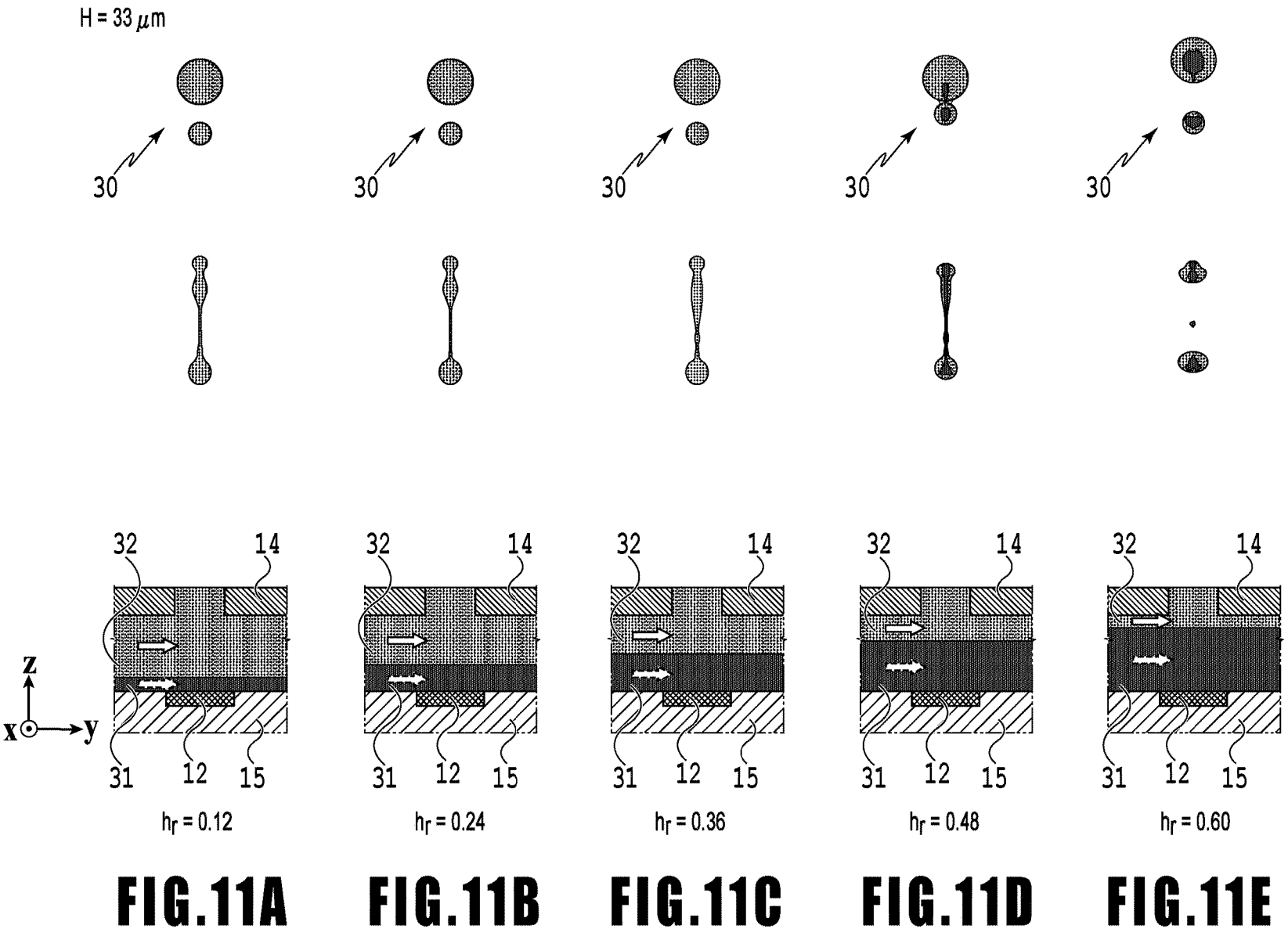
FIGS. 11A to 11E are more diagrams illustrating ejected droplets at various water phase thickness ratios.

Each of FIGS. 7A, 8A, and 9A shows a state before a voltage is applied to the pressure generation element 12. The first liquid 31 and the second liquid 32 form the parallel flows that flow in parallel in the y direction.

FIGS. 7B, 8B, and 9B show a state where application of the voltage to the pressure generation element 12 has just been started. The pressure generation element 12 of this embodiment is an electrothermal converter (a heater). To be more precise, the pressure generation element 12 rapidly generates heat upon receipt of a voltage pulse in response to the ejection signal, and causes film boiling of in the first liquid in contact. FIG. 7B shows the state where a bubble 16 is generated by the film boiling. Along with the generation of the bubble 16, the interface between the first liquid 31 and the second liquid 32 moves in the z direction whereby the second liquid 32 is pushed out of the ejection port 11 in the z direction (the height direction of the pressure chamber).

Each of FIGS. 7C, 8C, and 9C shows a state where the voltage application to the pressure generation element 12 is continued. A volume of the bubble 16 is increased by the film boiling and the second liquid 32 is in the state of being further pushed out of the ejection port 11 in the z direction.

Thereafter, as the voltage application to the pressure generation element 12 is further continued, the bubble 16 communicates with the atmosphere in the process of growth in the liquid flow passage 13 (the pressure chamber) shown in FIGS. 7D and 9D. This is because the liquid flow passage 13 shown in each of FIGS. 7D and 9D does not have a very large height H of the flow passage (the pressure chamber). On the other hand, in the liquid flow passage 13 (the pressure chamber) shown in FIG. 8D which has a relatively large height H, the bubble deflates without communicating with the atmosphere.

FIGS. 7E. 8E, and 9E show a state where a droplet (ejected droplet) 30 is ejected. The liquid having projected out of the ejection port 11 at the timing of the communication of the bubble 16 with the atmosphere as shown in FIGS. 7D and 9D or the timing of the deflation of the bubble 16 as shown in FIG. 8D breaks away from the liquid flow passage 13 (the pressure chamber) due to its inertial force and flies in the z direction in the form of the droplet 30. Meanwhile, in the liquid flow passage 13 (the pressure chamber), the liquid in the amount consumed by the ejection is supplied from two sides of the ejection port 11 by capillary force of the liquid flow passage 13 (the pressure chamber) whereby the meniscus is formed again at the ejection port 11.

Note that the above-described ejection operation can take place in a state where the liquids are flowing and in a state where the liquids are temporarily stopped, because it is possible to conduct the ejection operation in a stable state irrespective of whether or not the flows are active as long as the interface between the first liquid 31 and the second liquid 32 is held at a stable position.

In the case where the ejection operation is conducted in the state where the liquids are flowing, for example, the flows of the liquids may adversely affect ejection performances. However, in the general inkjet printing head, an ejection velocity of each droplet is in the order of several meters per second to ten something meters per second, which is much higher than the flow velocity in the liquid flow passage (the pressure chamber) that is in the order of several millimeters per second to several meters per second. Accordingly, even if the ejection operation is conducted in the state where the first liquid and the second liquid are flowing in the range from several millimeters per second to several meters per second, there is little risk of adverse effects on the ejection performances.

On the other hand, in the case where the ejection operation is conducted in the state where the liquids are temporarily stopped, the position of the interface between the first liquid and the second liquid may fluctuate with the ejection operation. For this reason, it is desirable to conduct ejection while keeping the first liquid and the second liquid flowing. Note that the interface between the first liquid and the second liquid does not mingle due to a diffusion effect immediately after the stop of the flows of the liquids. Even if the flows are stopped, the interface between the first liquid and the second liquid is maintained in the case where the stop period is a short period adequate for conducting the ejection operation, so that the ejection operation may take place in that state. Then, if the flows of the liquids are resumed at the flow rates that satisfy the (formula 3) after completion of the ejection operation, the parallel flows in the liquid flow passage 13 (the pressure chamber) will be retained in the stable state.

However, this embodiment is assumed to conduct the ejection operation in the former state, that is, in the state where the liquids are flowing, so as to suppress the effect of the diffusion as little as possible and to eliminate the need for on-off switching control.

(Ratios of Liquids Contained in Ejected Droplet)

FIGS. 10A to 10G are diagrams for comparing the ejected droplet in the case where the water phase thickness ratio $h_r$ is changed stepwise in the liquid flow passage 13 (the pressure chamber) having the flow-passage (pressure-chamber) height of H [μm]=20 μm. In FIGS. 10A to 10F, the water phase thickness ratio $h_r$ is incremented by 0.10 whereas the water phase thickness ratio $h_r$ is incremented by 0.50 from the state in FIG. 10F to the state in FIG. 10G.

The water phase thickness ratio h1 of the first liquid 31 is lower as the water phase thickness ratio hr (=h1/(h1+h2)) shown in FIG. 4D is closer to 0, and the water phase thickness ratio h1 of the first liquid 31 is higher as the water phase thickness ratio hr is closer to 1. Accordingly, while the second liquid 32 located close to the ejection port 11 is mainly contained in the ejected droplet 30, the ratio of the first liquid 31 contained in the ejected droplet 30 is also increased as the water phase thickness ratio hr comes closer to 1.

In the case of FIGS. 10A to 10G where the flow-passage (pressure-chamber) height is set to H [μm]=20 μm, only the second liquid 32 is contained in the ejected droplet 30 if the water phase thickness ratio $h_r$=0.00, 0.10, or 0.20 and no first liquid 31 is contained in the ejected droplet 30. However, in the case where the water phase thickness ratio $h_r$=0.30 or higher, the first liquid 31 is also contained in the ejected droplet 30 besides the second liquid 32. In the case where the water phase thickness ratio $h_r$=1.00 (that is, the state where the second liquid is absent), only the first liquid 31 is contained in the ejected droplet 30. As described above, the ratio between the first liquid 31 and the second liquid 32 contained in the ejected droplet 30 varies depending on the water phase thickness ratio $h_r$ in the liquid flow passage 13 (the pressure chamber).

On the other hand, FIGS. 11A to 11E are diagrams for comparing the ejected droplet 30 in the case where the water phase thickness ratio $h_r$ is changed stepwise in the liquid flow passage 13 having the flow-passage (pressure-chamber) height of H [μm]=33 μm. In this case, only the second liquid 32 is contained in the ejected droplet 30 if the water phase thickness ratio $h_r$=0.36 or below. Meanwhile, the first liquid 31 is also contained in the ejected droplet 30 besides the second liquid 32 in the case where the water phase thickness ratio $h_r$=0.48 or above.

Figure 12A:
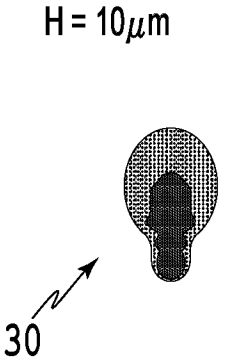
FIGS. 12A to 12C are more diagrams illustrating ejected droplets at various water phase thickness ratios.
Figure 12A:
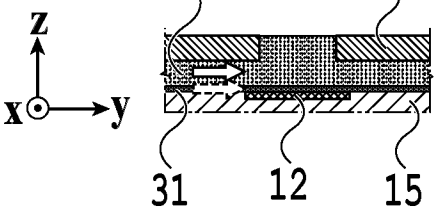
Figure 12B:
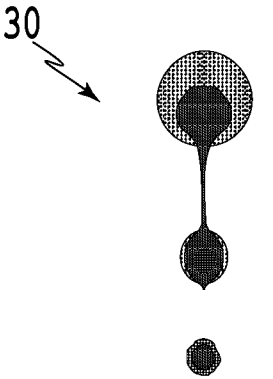
Figure 12B:
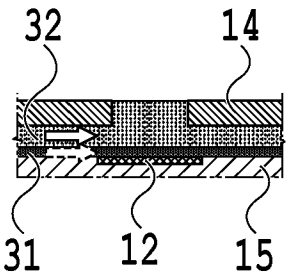
Figure 12C:
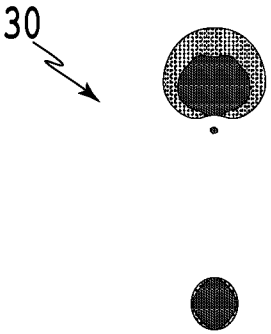
Figure 12C:
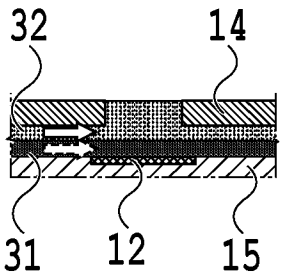

In the meantime, FIGS. 12A to 12C are diagrams for comparing the ejected droplet 30 in the case where the water phase thickness ratio $h_r$ is changed stepwise in the liquid flow passage 13 having the flow-passage (pressure-chamber) height of H [μm]=10 μm. In this case, the first liquid 31 is contained in the ejected droplet 30 even in the case where the water phase thickness ratio $h_r$=0.10.

Figure 13:
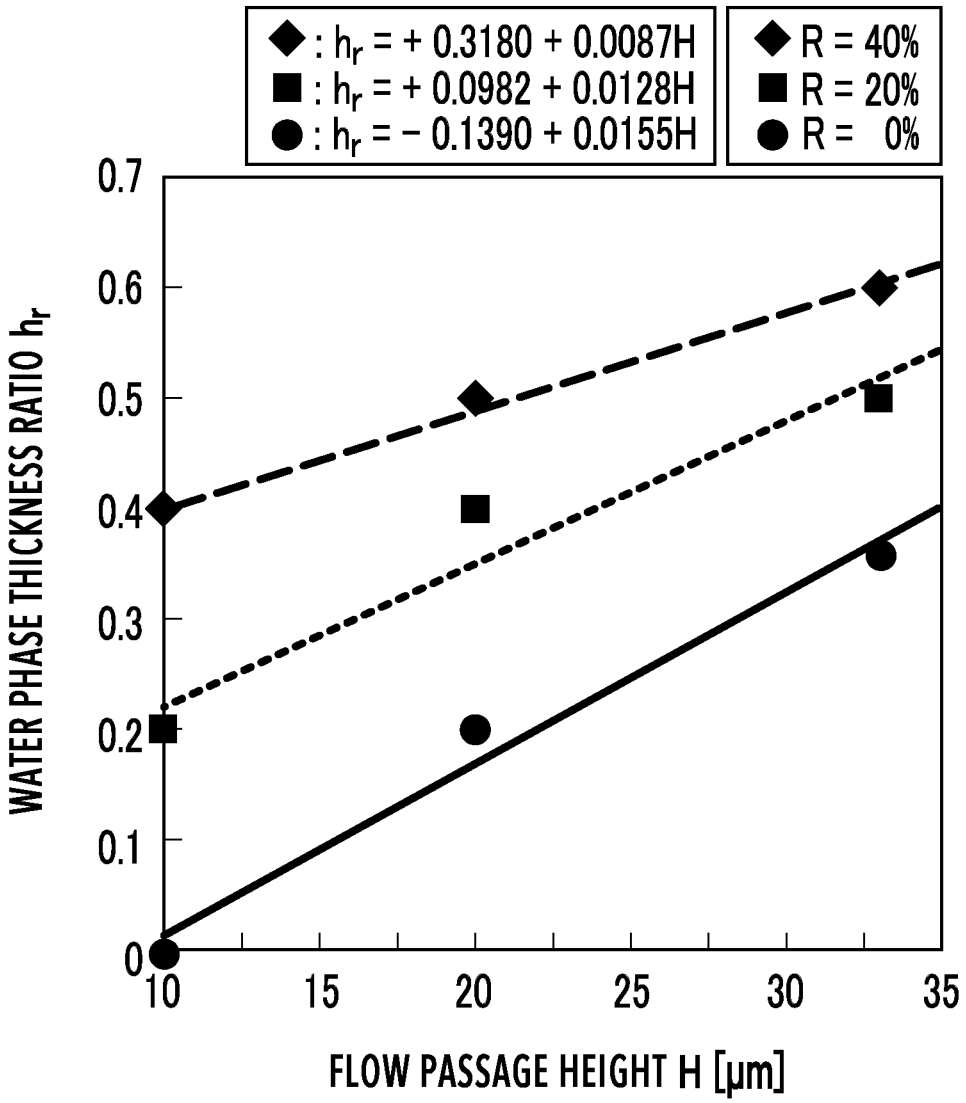
FIG. 13 is a graph representing a relation between a height of a flow passage (the pressure chamber) and the water phase thickness ratio.

FIG. 13 is a graph representing a relation between the flow-passage (pressure-chamber) height H and the water phase thickness ratio $h_r$ in the case of fixing a ratio R of the first liquid 31 contained in the ejected droplet 30, while setting the ratio R to 0%, 20%, and 40%. In any of the ratios R, the tolerable water phase thickness ratio $h_r$ becomes higher as the flow-passage (pressure-chamber) height H is larger. Note that the ratio R of the first liquid 31 contained is a ratio of the liquid having flowed in the liquid flow passage 13 (the pressure chamber) to the ejected droplet as the first liquid 31. In this regard, even if each of the first liquid and the second liquid contains the same component such as water, the portion of water contained in the second liquid is not included in the aforementioned ratio as a matter of course.

In the case where the ejected droplet 30 contains only the second liquid 32 while eliminating the first liquid (R=0%), the relation between the flow-passage (pressure-chamber) height H [μm] and the water phase thickness ratio $h_r$ draws a locus as indicated with a solid line in FIG. 11. According to the investigation conducted by the inventors of this disclosure, the water phase thickness ratio $h_r$ can be approximated by a linear function of the flow-passage (pressure-chamber) height H [μm] shown in the following (formula 7):

$$h_r=-0.1390+0.0155H \quad \text{(formula 7).}$$

Moreover, in the case where the ejected droplet 30 is allowed to contain 20% of the first liquid (R=20%), the water phase thickness ratio $h_r$ can be approximated by a linear function of the flow-passage (pressure-chamber) height H [μm] shown in the following (formula 8):

$$h_r=+0.0982+0.0128H \quad \text{(formula 8).}$$

Furthermore, in the case where the ejected droplet 30 is allowed to contain 40% of the first liquid (R=40%), the water phase thickness ratio $h_r$ can be approximated by a linear function of the flow-passage (pressure-chamber) height H [μm] shown in the following (formula 9) according to the investigation by the inventors:

$$h_r=+0.3180+0.0087H \quad \text{(formula 9).}$$

For example, in order for causing the ejected droplet 30 to contain no first liquid, the water phase thickness ratio $h_r$ needs to be adjusted to 0.20 or below in the case where the flow-passage (pressure-chamber) height H [μm] is equal to 20 μm. Meanwhile, the water phase thickness ratio $h_r$ needs to be adjusted to 0.36 or below in the case where the flow-passage (pressure-chamber) height H [μm] is equal to 33 μm. Furthermore, the water phase thickness ratio $h_r$ needs to be adjusted to nearly zero (0.00) in the case where the flow-passage (pressure-chamber) height H [μm] is equal to 10 μm.

Nonetheless, if the water phase thickness ratio $h_r$ is set too low, it is necessary to increase the viscosity $\eta_2$ and the flow rate $Q_2$ of the second liquid relative to those of the first liquid. Such increases bring about concerns of adverse effects associated with an increase in pressure loss. For example, with reference to FIG. 5A again, in order to realize the water phase thickness ratio $h_r$=0.20, the flow rate ratio $Q_r$ is equal to 5 in the case where the viscosity ratio $\eta_r$ is equal to 10. Meanwhile, the flow rate ratio $Q_r$ is equal to 15 if the water phase thickness ratio is set to $h_r$=0.10 in order to obtain certainty of not ejecting the first liquid while using the same ink (that is, in the case of the same viscosity ratio $\eta_r$). In other words, in order for adjusting the water phase thickness ratio $h_r$ to 0.10, it is necessary to increase the flow rate ratio $Q_r$ three times as high as the case of adjusting the water phase thickness ratio $h_r$ to 0.20, and such an increase may bring about concerns of an increase in pressure loss and adverse effects associated therewith.

Accordingly, in an attempt to eject only the second liquid 32 while reducing the pressure loss as much as possible, it is preferable to adjust the value of the water phase thickness ratio $h_r$ as large as possible while satisfying the above-mentioned conditions. To describe this in detail with reference to FIG. 13 again, in the case where the flow-passage (pressure-chamber) height H=20 μm, it is preferable to adjust the value of the water phase thickness ratio $h_r$ less than 0.20 and as close to 0.20 as possible. Meanwhile, in the case where the flow-passage (pressure-chamber) height H [μm]=33 μm, it is preferable to adjust the value of the water phase thickness ratio $h_r$ less than 0.36 and as close to 0.36 as possible.

Note that the above-mentioned (formula 7), (formula 8), and (formula 9) define the numerical values applicable to the general liquid ejection head, namely, the liquid ejection head with the ejection velocity of the ejected droplets in a range from 10 m/s to 18 m/s. In addition, these numerical values are based on the assumption that the pressure generation element and the ejection port are located at the positions opposed to each other and that the first liquid and the second liquid flow such that the pressure generation element, the first liquid, the second liquid, and the ejection port are arranged in the order of enumeration in the pressure chamber.

As described above, according to this embodiment, it is possible to stably conduct the ejection operation of the droplet containing the first liquid and the second liquid at the predetermined ratio by setting the water phase thickness ratio $h_r$ in the liquid flow passage (the pressure chamber) to the predetermined value and thus stabilizing the interface.

(Specific Examples of First Liquid and Second Liquid)

In the configuration of the embodiment described above, functions required by the respective liquids are clarified like the first liquid serving as a bubbling medium for causing the film boiling and the second liquid serving as an ejection medium to be ejected to the atmosphere. According to the configuration of this embodiment, it is possible to increase the freedom of components to be contained in the first liquid and the second liquid more than those in the related art. Now, the bubbling medium (the first liquid) and the ejection medium (the second liquid) in this configuration will be described in detail based on specific examples.

The bubbling medium (the first liquid) of this embodiment is required to cause the film boiling in the bubbling medium in the case where the electrothermal converter generates the heat and to rapidly increase the size of the generated bubble, or in other words, to have a high critical pressure that can efficiently convert thermal energy into bubbling energy. Water is particularly suitable for such a medium. Water has the high boiling point (100° C.) as well as the high surface tension (58.85 dynes/cm at 100° C.) despite its small molecular weight of 18, and therefore has a high critical pressure of about 22 MPa. In other words, water brings about an extremely high boiling pressure at the time of the film boiling. In general, an ink prepared by causing water to contain a coloring material such as a dye or a pigment is suitably used in an inkjet printing apparatus designed to eject the ink by using the film boiling.

However, the bubbling medium is not limited to water. Other materials can also function as the bubbling media as long as such a material has a critical pressure of 2 MPa or above (or preferably 5 MPa or above). Examples of the bubbling media other than water include methyl alcohol and ethyl alcohol. It is also possible to use a mixture of water and any of these alcohols as the bubbling medium. Moreover, it is possible use a material prepared by causing water to contain the coloring material such as the dye and the pigment as mentioned above as well as other additives.

On the other hand, the ejection medium (the second liquid) of this embodiment is not required to satisfy physical properties for causing the film boiling unlike the bubbling medium. Meanwhile, adhesion of a scorched material onto the electrothermal converter (the heater) is prone to deteriorate bubbling efficiency because of damaging flatness of a heater surface or reducing thermal conductivity thereof. However, the ejection medium does not come into direct contact with the heater, and therefore has no risk of scorch of its components. Specifically, concerning the ejection medium of this embodiment, conditions of the physical properties for causing the film boiling or avoiding the scorch are relaxed as compared to those of an ink for a conventional thermal head. Accordingly, the ejection medium of this embodiment enjoys more freedom of the components to be contained therein. As a consequence, the ejection medium can more actively contain the components that are suitable for purposes after being ejected.

For example, in this embodiment, it is possible to cause the ejection medium to actively contain a pigment that has not been used previously because the pigment was susceptible to scorching on the heater. Meanwhile, a liquid other than an aqueous ink having an extremely low critical pressure can also be used as the ejection medium in this embodiment. Furthermore, it is also possible to use various inks having special functions, which can hardly be handled by the conventional thermal head such as an ultraviolet curable ink, an electrically conductive ink, an electron-beam (EB) curable ink, a magnetic ink, and a solid ink, can also be used as the ejection media. In the meantime, the liquid ejection head of this embodiment can also be used in various applications other than image formation by using any of blood, cells in culture, and the like as the ejection media. The liquid ejection head is also adaptable to other applications including biochip fabrication, electronic circuit printing, and so forth. Since there are no restrictions regarding the second liquid, the second liquid may adopt the same liquid as one of those cited as the examples of the first liquid. For instance, even if both of the two liquids are inks each containing a large amount of water, it is still possible to use one of the inks as the first liquid and the other ink as the second liquid depending on situations such as a mode of usage.

(Ejection Medium that Require Parallel Flows of Two Liquids)

In the case where the liquid to be ejected has been determined, the necessity of causing the two liquids to flow in the liquid flow passage (the pressure chamber) in such a way as to form the parallel flows may be determined based on the critical pressure of the liquid to be ejected. For example, the second liquid may be determined as the liquid to be ejected while the bubbling material serving as the first liquid may be prepared only in the case where the critical pressure of the liquid to be ejected is insufficient.

Figure 14A:
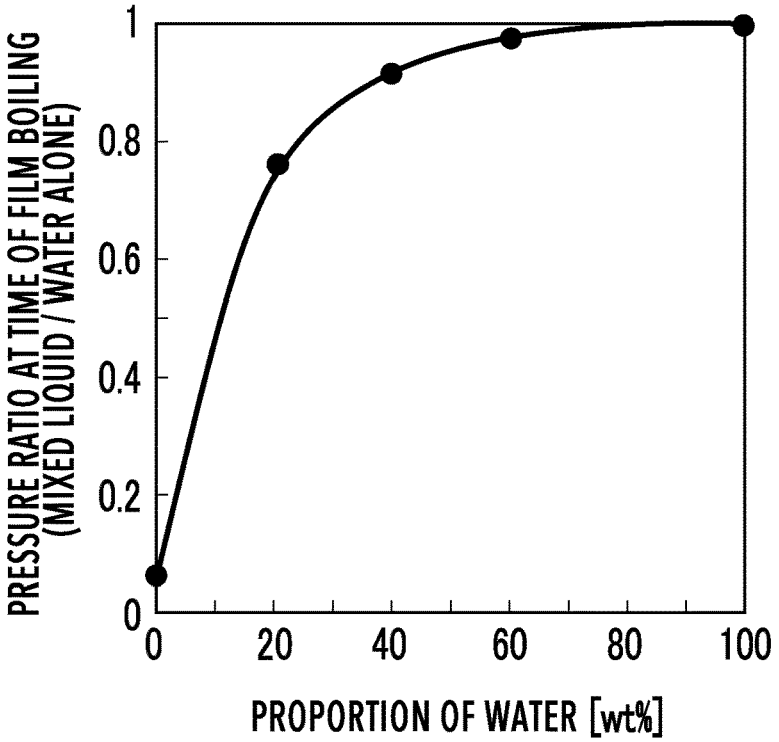
FIGS. 14A and 14B are graphs representing relations between a water content rate and a bubbling pressure.
Figure 14B:
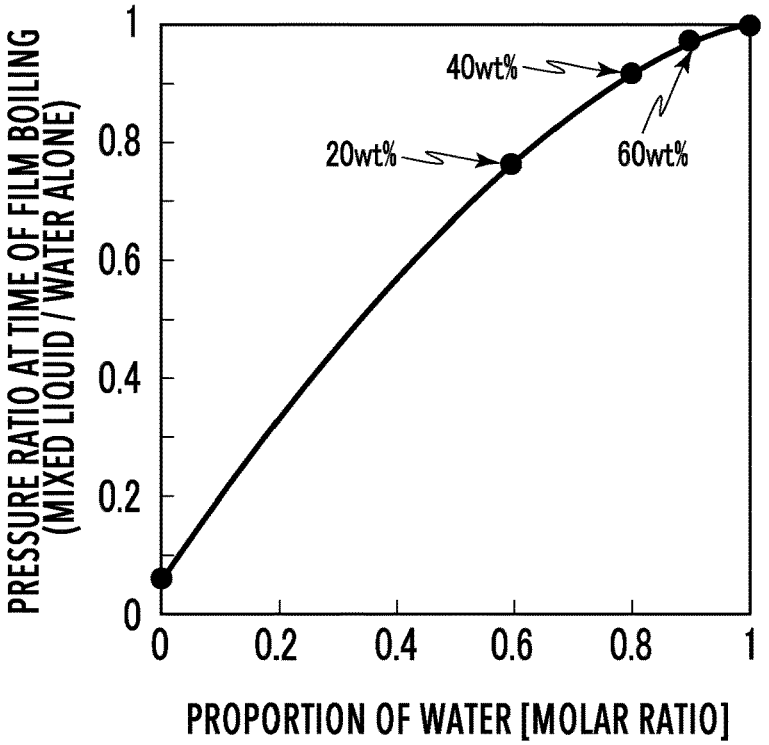

FIGS. 14A and 14B are graphs representing relations between a water content rate and a bubbling pressure at the time of the film boiling in the case where diethylene glycol (DEG) is mixed with water. The horizontal axis in FIG. 14A indicates a mass ratio (in percent by mass) of water relative to the liquid, and the horizontal axis in FIG. 14B indicates a molar ratio of water relative to the liquid.

As apparent from FIGS. 14A and 14B, the bubbling pressure at the time of the film boiling becomes lower as the water content rate (content percentage) is lower. In other words, the bubbling pressure is reduced more as the water content rate becomes lower, and ejection efficiency is deteriorated as a consequence. Nonetheless, the molecular weight of water (18) is substantially smaller than the molecular weight of diethylene glycol (106). Accordingly, even if the mass ratio of water is around 40 wt %, its molar ratio is about 0.9 and the bubbling pressure ratio is kept at 0.9. On the other hand, if the mass ratio of water falls below 40 wt %, the bubbling pressure ratio sharply drops together with the molar concentration as apparent from FIGS. 14A and 14B.

As a consequence, in the case where the mass ratio of water falls below 40 wt %, it is preferable to prepare the first liquid separately as the bubbling medium and to form the parallel flows of these two liquids in the liquid flow passage (the pressure chamber). As described above, in the case where the liquid to be ejected has been determined, the necessity of forming the parallel flows in the flow passage (the pressure chamber) can be determined based on the critical pressure of the liquid to be ejected (or on the bubbling pressure at the time of the film boiling).

(Ultraviolet Curable Ink as Example of Ejection Medium)

A preferable composition of an ultraviolet curable ink that can be used as the ejection medium in this embodiment will be described as an example. The ultraviolet curable ink is of a 100-percent solid type. Such ultraviolet curable inks can be categorized into an ink formed from a polymerization reaction component without a solvent, and an ink containing either water being of a solvent type or a solvent as a diluent. The ultraviolet curable inks actively used in recent years are 100-percent solid ultraviolet curable inks formed from non-aqueous photopolymerization reaction components (which are either monomers or oligomers) without containing any solvents. As for the composition, the typical ultraviolet curable ink contains monomers as a main component, and also contains small amounts of a photopolymerization initiator, a coloring material, and other additives including a dispersant, a surfactant, and the like. Broadly speaking, the components of this ink include the monomers in a range from 80 to 90 wt %, the photopolymerization initiator in a range from 5 to 10 wt %, the coloring material in a range from 2 to 5 wt %, and other additives for the rest. As described above, even in the case of the ultraviolet curable ink that has been hardly handled by the conventional thermal head, it is possible to use this ink as the ejection medium in this embodiment and to eject the ink out of the liquid ejection head by conducting the stable ejection operation. This makes it possible to print an image that is excellent in image robustness as well as abrasion resistance as compared to the related art.

(Example of Using Mixed Liquid as Ejected Droplet)

Next, a description will be given of a case of ejection of the ejected droplet 30 in the state where the first liquid 31 and the second liquid 32 are mixed at a predetermined ratio. For instance, in the case where the first liquid 31 and the second liquid 32 are inks having colors different from each other, these inks are able to flow stably without being mixed in the liquid flow passage 13 and the pressure chamber 18 as long as the viscosities and the flow rates of the two liquids satisfy the relation defined by (formula 2) or (formula 3). In other words, by controlling the flow rate ratio $Q_r$ between the first liquid 31 and the second liquid 32 in the liquid flow passage and the pressure chamber, it is possible to adjust the water phase thickness ratio $h_r$ and therefore a mixing ratio between the first liquid 31 and the second liquid 32 in the ejected droplet to a desired ratio.

For example, assuming that the first liquid is a clear ink and the second liquid is cyan ink (or magenta ink), it is possible to eject light cyan ink (or light magenta ink) at various concentrations of the coloring material by controlling the flow rate ratio $Q_r$. Alternatively, assuming that the first liquid is yellow ink and the second liquid is magenta, it is possible to eject red ink at various color phase levels that are different stepwise by controlling the flow rate ratio $Q_r$. In other words, if it is possible to eject the droplet prepared by mixing the first liquid and the second liquid at the desired mixing ratio, then a range of color reproduction expressed on a printed medium can be expanded more than the related art by appropriately adjusting the mixing ratio.

Moreover, the configuration of this embodiment is also effective in the case of using two types of liquids that are desired to be mixed together immediately after the ejection instead of mixing the liquids immediately before the ejection. For example, there is a case in image printing where it is desirable to deposit a high-density pigment ink with excellent chromogenic properties and a resin emulsion (resin EM) excellent in image robustness such as abrasion resistance on a printing medium at the same time. However, a pigment component contained in the pigment ink and a solid component contained in the resin EM tend to develop agglomeration at a close interparticle distance, thus causing deterioration in dispersibility. In this regard, if the high-density EM is used as the first liquid of this embodiment while the high-density pigment ink is used as the second liquid thereof and the parallel flows are formed by controlling the flow velocities of these liquids based on (formula 2) or (formula 3), then the two liquids are mixed with each other and agglomerated together on the printing medium after being ejected. In other words, it is possible to maintain a desirable state of ejection under high dispersibility and to obtain an image with high chromogenic properties as well as high robustness after deposition of the droplets.

Note that in the case where the mixture after the ejection is intended as mentioned above, this embodiment exerts an effect of generating the flows of the two liquids in the pressure chamber regardless of the mode of the pressure generation element. In other words, this embodiment also functions effectively in the case of a configuration to use a piezoelectric element as the pressure generation element, for instance, where the limitation in the critical pressure or the problem of the scorch is not concerned in the first place.

As described above, according to this embodiment, the flow rate ratio $Q_r$ is adjusted based on the approximation formulae defined in the (formula 4) to the (formula 6) in order to set the first liquid having the viscosity $\eta_1$ and the second liquid having the viscosity $\eta_2$ to the predetermined water phase thickness ratio $h_r$. This makes it possible to stabilize the interface at the predetermined position by setting the water phase thickness ratio $h_r$ in the liquid flow passage (the pressure chamber) to the predetermined value, and to stably conduct the ejection operation of the droplets that contain the first liquid and the second liquid at constant percentages.

The first liquid and the second liquids flowing in the pressure chamber may be circulated between the pressure chamber and an outside unit. If the circulation is not conducted, a large amount of any of the first liquid and the second liquid having formed the parallel flows in the liquid flow passage and the pressure chamber but having not been ejected would remain inside. Accordingly, the circulation of the first liquid and the second liquid with the outside unit makes it possible to use the liquids that have not been ejected in order to form the parallel flows again.

OTHER EMBODIMENTS

In this disclosure, the liquid ejection head and the liquid ejection apparatus are not limited only to the inkjet printing head and the inkjet printing apparatus configured to eject an ink. The liquid ejection head, the liquid ejection apparatus, and a liquid ejection method associated therewith are applicable to various apparatuses including a printer, a copier, a facsimile machine equipped with a telecommunication system, and a word processor including a printer unit, and to other industrial printing apparatuses that are integrally combined with various processing apparatuses. In particular, since various liquids can be used as the second liquid, the present invention is also adaptable to other applications including biochip fabrication, electronic circuit printing, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-143176 filed Jul. 31, 2018, and No. 2019-079642 filed Apr. 18, 2019, which are hereby incorporated by reference herein in their entirety

What is claimed is:

1. A liquid ejection head comprising:

a pressure chamber configured to allow a first liquid and a second liquid to flow inside;

a pressure generation element configured to apply pressure to the first liquid; and an ejection port configured to eject the second liquid, wherein the liquid ejection head is configured to make the second liquid flow on a side closer to the ejection port than the first liquid and in contact with the first liquid in the pressure chamber, the first liquid and the second liquid flow in the same direction, and the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate of the first liquid, and $Q_2$ is a flow rate of the second liquid.

2. The liquid ejection head according to claim 1, wherein the first liquid and the second liquid flowing in the pressure chamber satisfy $$0.0<0.44(Q_2/Q_1)^{-0.322}(\eta_2/\eta_1)^{-0.109}\leq 0.8.$$

3. The liquid ejection head according to claim 1, wherein the first liquid and the second liquid flowing in the pressure chamber satisfy $$0.0<0.44(Q_2/Q_1)^{-0.322}(\eta_2/\eta_1)^{-0.109}\leq 0.5.$$

4. The liquid ejection head according to claim 1, wherein the liquid ejection head is configured to make the first liquid and the second liquid form laminar flows in the pressure chamber.

5. The liquid ejection head according to claim 1, wherein the liquid ejection head is configured to make the first liquid and the second liquid form parallel flows in the pressure chamber.

6. The liquid ejection head according to claim 5, wherein the pressure generation element and the ejection port are located at positions opposed to each other, and the first liquid and the second liquid flow in the pressure chamber such that the pressure generation element, the first liquid, the second liquid, and the ejection port are arranged in the listed order.

7. The liquid ejection head according to claim 6, wherein the liquid ejection head satisfies $$h_1/(h_1+h_2)\leq -0.1390+0.0155H,$$

where H [μm] is a height of the pressure chamber, $h_1$ is a thickness of the first liquid in the pressure chamber in the direction of ejection of the second liquid, and $h_2$ is a thickness of the second liquid in the pressure chamber in the direction of ejection of the second liquid.

8. The liquid ejection head according to claim 1, wherein a percentage of the first liquid in an ejected droplet ejected from the ejection port is below 20%.

9. The liquid ejection head according to claim 1, wherein a percentage of the first liquid in an ejected droplet ejected from the ejection port is below 1%.

10. The liquid ejection head according to claim 1, wherein the pressure generation element and the ejection port are located at positions opposed to each other, and the first liquid and the second liquid flow in the pressure chamber such that the pressure generation element, the first liquid, the second liquid, and the ejection port are arranged in the listed order.

11. The liquid ejection head according to claim 10, wherein the liquid ejection head satisfies $$h_1/(h_1+h_2)\leq +0.3180+0.0087H,$$

where H [μm] is a height of the pressure chamber, $h_1$ is a thickness of the first liquid in the pressure chamber in the direction of ejection of the second liquid, and $h_2$ is a thickness of the second liquid in the pressure chamber in the direction of ejection of the second liquid.

12. The liquid ejection head according to claim 10, wherein the liquid ejection head satisfies $$h_1/(h_1+h_2) \leq +0.0982+0.0128H,$$

where H [μm] is a height of the pressure chamber, $h_1$ is a thickness of the first liquid in the pressure chamber in the direction of ejection of the second liquid, and $h_2$ is a thickness of the second liquid in the pressure chamber in the direction of ejection of the second liquid.

13. The liquid ejection head according to claim 10, wherein the liquid ejection head satisfies $$h_1/(h_1+h_2) \leq -0.1390+0.0155H,$$

where H [μm] is a height of the pressure chamber, $h_1$ is a thickness of the first liquid in the pressure chamber in the direction of ejection of the second liquid, and $h_2$ is a thickness of the second liquid in the pressure chamber in the direction of ejection of the second liquid.

14. The liquid ejection head according to claim 1, wherein the pressure generation element generates heat upon receipt of an applied voltage and causes film boiling in the first liquid, and the second liquid is ejected from the ejection port by growth of a generated bubble.

15. The liquid ejection head according to claim 1, wherein the first liquid is a liquid having a critical pressure equal to or above 2 MPa.

16. The liquid ejection head according to claim 1, wherein the second liquid is any of an emulsion and an aqueous ink that contains a pigment.

17. The liquid ejection head according to claim 1, wherein the second liquid is a solid-type ultraviolet curable ink.

18. The liquid ejection head according to claim 1, wherein the first liquid flowing in the pressure chamber is circulated between the pressure chamber and an outside unit.

19. A liquid ejection apparatus including a liquid ejection head, the liquid ejection head comprising:

a pressure chamber configured to allow a first liquid and a second liquid to flow inside;

a pressure generation element configured to apply pressure to the first liquid; and an ejection port configured to eject the second liquid, wherein the liquid ejection head is configured to make the second liquid flow on a side closer to the ejection port than the first liquid and in contact with the first liquid in the pressure chamber, the first liquid and the second liquid flow in the same direction, and the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate of the first liquid, and $Q_2$ is a flow rate of the second liquid.

20. A liquid ejection module for configuring a liquid ejection head, the liquid ejection head comprising:

a pressure chamber configured to allow a first liquid and a second liquid to flow inside;

a pressure generation element configured to apply pressure to the first liquid; and an ejection port configured to eject the second liquid, wherein the liquid ejection head is configured to make the second liquid flow on a side closer to the ejection port than the first liquid and in contact with the first liquid in the pressure chamber, the first liquid and the second liquid flow in the same direction, the first liquid and the second liquid flowing in the pressure chamber satisfy $$0.0<0.44(Q_2/Q_1)^{-0.322}(\eta_2/\eta_1)^{-0.109}<1.0,$$

where $\eta_1$ is a viscosity of the first liquid, $\eta_2$ is a viscosity of the second liquid, $Q_1$ is a flow rate of the first liquid, and $Q_2$ is a flow rate of the second liquid, and the liquid ejection head is formed by arraying multiple liquid ejection modules.

* * * * *